US011038314B2

(12) United States Patent
Takano et al.

(10) Patent No.: US 11,038,314 B2
(45) Date of Patent: Jun. 15, 2021

(54) ELECTRONIC DEVICE ASSEMBLING APPARATUS

(71) Applicant: Panasonic Intellectual Property Management Co., Ltd., Osaka (JP)

(72) Inventors: Ken Takano, Osaka (JP); Yuji Takahashi, Yamagata (JP); Kazu Wagatsuma, Yamagata (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 249 days.

(21) Appl. No.: 16/032,094

(22) Filed: Jul. 11, 2018

(65) Prior Publication Data

US 2019/0027887 A1 Jan. 24, 2019

(30) Foreign Application Priority Data

Jul. 20, 2017 (JP) ..... JP2017-140517

(51) Int. Cl.

| | |
|---|---|
| ***H01R 43/26*** | (2006.01) |
| ***H01R 12/70*** | (2011.01) |
| ***H01R 43/20*** | (2006.01) |
| *H01R 12/79* | (2011.01) |
| *H01R 12/88* | (2011.01) |

(52) U.S. Cl.

CPC ..... *H01R 43/26* (2013.01); *H01R 43/20* (2013.01); *H01R 12/7023* (2013.01); *H01R 12/79* (2013.01); *H01R 12/88* (2013.01); *Y10T 29/53209* (2015.01); *Y10T 29/53213* (2015.01)

(58) Field of Classification Search

CPC .... H01R 43/20; H01R 43/26; H01R 12/7023; H01R 12/79; H01R 12/88; Y10T 29/53209; Y10T 29/53213

See application file for complete search history.

(56) References Cited

U.S. PATENT DOCUMENTS

| | | | | |
|---|---|---|---|---|
| 2004/0266276 | A1 | 12/2004 | Hariki et al. | |
| 2008/0168867 | A1* | 7/2008 | Reker | H01R 43/26 81/99 |
| 2016/0064888 | A1* | 3/2016 | Katou | H01R 43/20 29/854 |
| 2018/0123306 | A1 | 5/2018 | Takano et al. | |

(Continued)

FOREIGN PATENT DOCUMENTS

| | | |
|---|---|---|
| CN | 108000137 A | 5/2018 |
| CN | 108015507 A | 5/2018 |

(Continued)

OTHER PUBLICATIONS

English Translation of Chinese Search Report dated Jan. 18, 2021 for the related Chinese Patent Application No. 201810763226.5.

*Primary Examiner* — A. Dexter Tugbang

(74) *Attorney, Agent, or Firm* — Pearne & Gordon LLP

(57) ABSTRACT

An electronic device assembling apparatus has a cable holder and a lock member operator. The cable holder holds a cable and inserts the cable into a connector. After the cable is inserted into the connector by the cable holder, the lock member operator operates a lock member to lock the cable to the connector. The lock member operator starts an operation with respect to the lock member in a state where the cable inserted into the connector is held by the cable holder.

10 Claims, 22 Drawing Sheets

(56) References Cited

U.S. PATENT DOCUMENTS

| | | | |
|---|---|---|---|
| 2018/0123307 | A1 | 5/2018 | Takano et al. |
| 2018/0243907 | A1 | 8/2018 | Takeyama et al. |
| 2018/0243909 | A1 | 8/2018 | Takano et al. |

FOREIGN PATENT DOCUMENTS

| | | | | |
|---|---|---|---|---|
| CN | 108512008 | A | | 9/2018 |
| JP | H06-096816 | A | | 4/1994 |
| JP | 2005-011580 | | | 1/2005 |
| JP | 2013007938 | A | * | 1/2013 |
| NO | 2017/046975 | A1 | | 3/2017 |

* cited by examiner

ELECTRONIC DEVICE ASSEMBLING APPARATUS

BACKGROUND

1. Technical Field

This disclosure relates to an electronic device assembling apparatus and an electronic device assembling method for assembling an electronic device by inserting a cable into a connector.

2. Description of the Related Art

In various electronic devices including electronic devices for use in vehicles (for example, instrument panel meters, navigation devices, room mirrors, or the like), functional modules such as display devices and circuit boards are electrically connected and assembled by cables such as flexible cables. In assembling such an electronic device, in the related art, a worker manually inserts the cable into the connector. However, in recent years, automation of the work has been proposed for the purpose of improving work quality and the like.

For example, Japanese Patent Unexamined Publication No. 2005-11580 (PTL 1) discloses a method of assembling an electronic device in which a cable with a connector is inserted into a connector on a board side by two robots. In this assembling method, cables with connectors are transferred between two robots having a camera, and connectors are connected to each other while checking the position of the mating connector with a camera.

SUMMARY

According to this disclosure, there is provided an electronic device assembling apparatus that assembles an electronic device by inserting a cable into a connector and locking the cable with a lock member of the connector. The electronic device assembling apparatus has a cable holder and a lock member operator.

The cable holder holds the cable and inserts the cable into the connector.

After the cable is inserted into the connector by the cable holder, the lock member operator operates the lock member to lock the cable to the connector.

The lock member operator starts an operation with respect to the lock member in a state where the cable inserted into the connector is held by the cable holder.

An electronic device assembling method of this disclosure is an electronic device assembling method for assembling an electronic device by inserting a cable into a connector.

The electronic device assembling method includes: a cable holding step of holding a cable in a cable holder, a cable insertion step of inserting the cable into a connector, and a locking member operating step of operating a locking member by a locking member operator to lock the cable to the connector, in which an operation of the lock member by the lock member operator is started in a state where the cable inserted into the connector is held by the cable holder.

DETAILED DESCRIPTION

In the related art example illustrated in PTL 1, two robots are required for an operation of inserting a cable into a connector. Therefore, a facility configuration becomes complicated and large, and an operating step becomes complicated.

Figure 1:
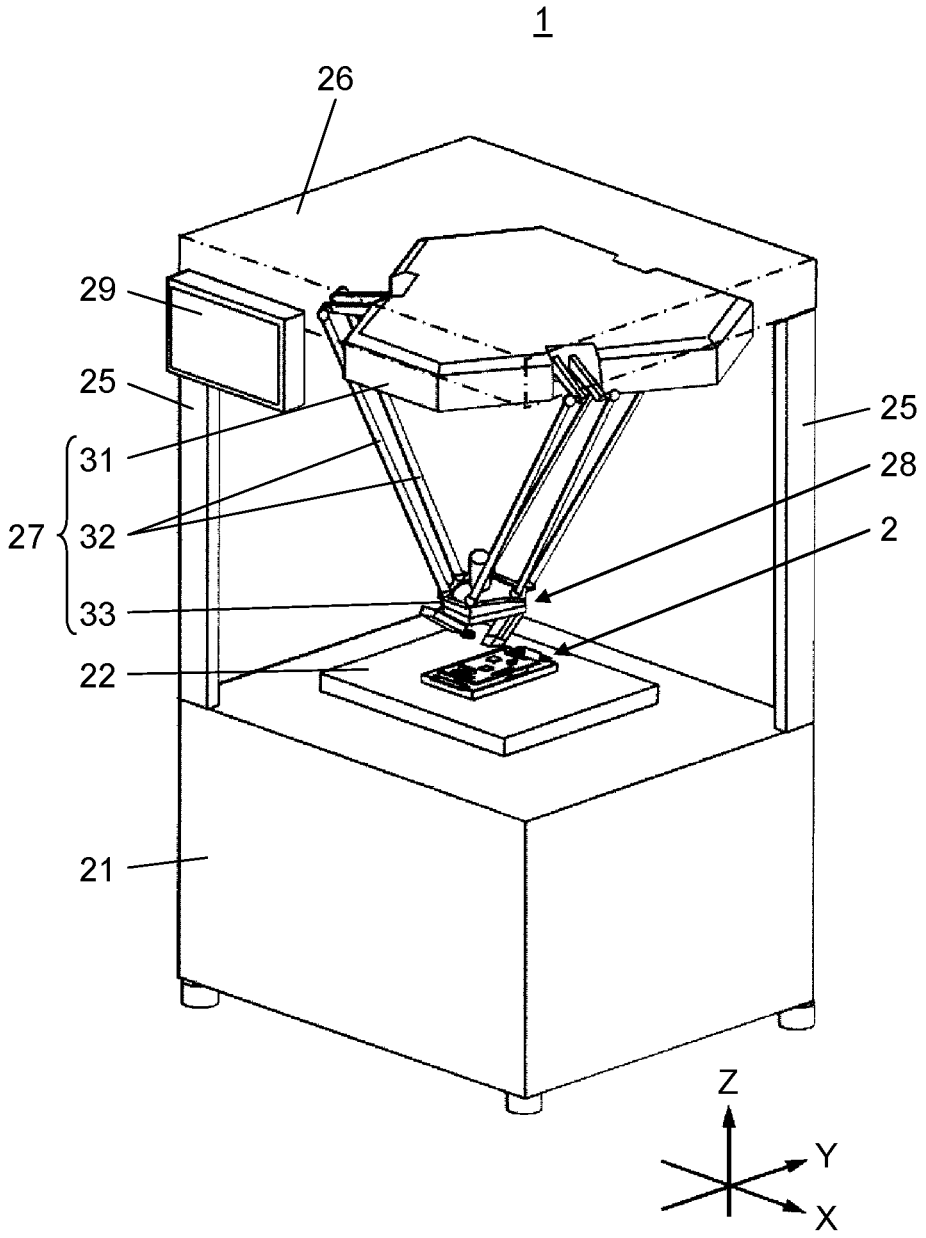
FIG. 1 is a perspective view illustrating an electronic device assembling apparatus according to an exemplary embodiment.

Hereinafter, an exemplary embodiment of this disclosure will be described with reference to the drawings. FIG. 1 illustrates electronic device assembling apparatus 1 according to the exemplary embodiment of this disclosure. Electronic device assembling apparatus 1 performs a predetermined work on electronic device 2 before assembly illustrated in FIG. 2A to obtain electronic device 2 after assembly illustrated in FIG. 2B. In the exemplary embodiment, a left and right direction as viewed from the front of electronic device assembling apparatus 1 is defined as an X-axis, and a front and rear direction viewed from the front is defined as a Y-axis. Also, an up and down direction is defined as a Z-axis.

Figure 2A:
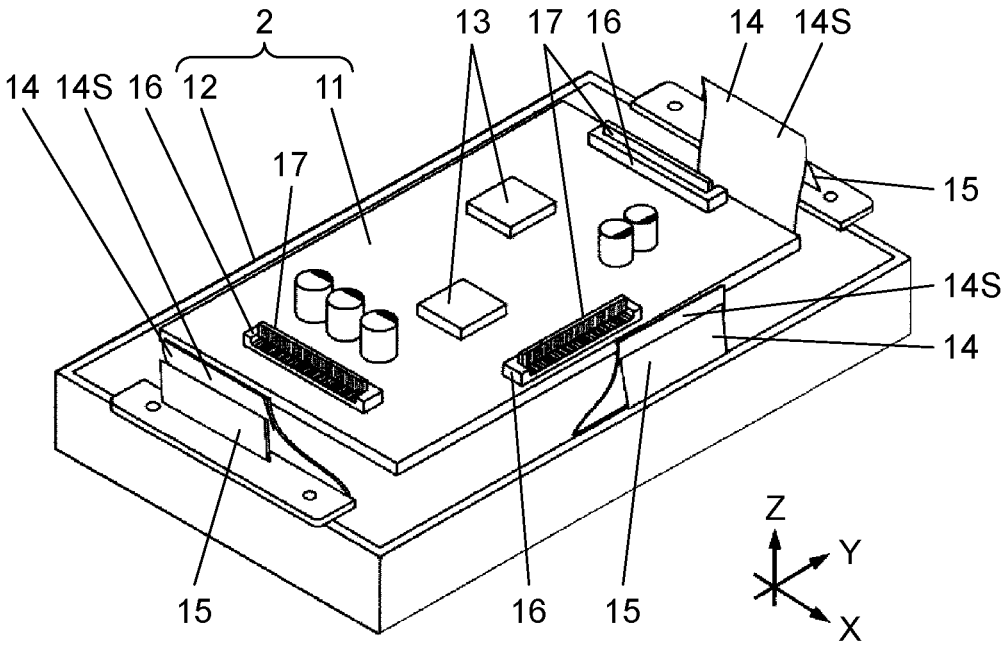
FIG. 2A is a perspective view illustrating an electronic device as a work target of an electronic device assembling apparatus according to the exemplary embodiment.
Figure 2B:
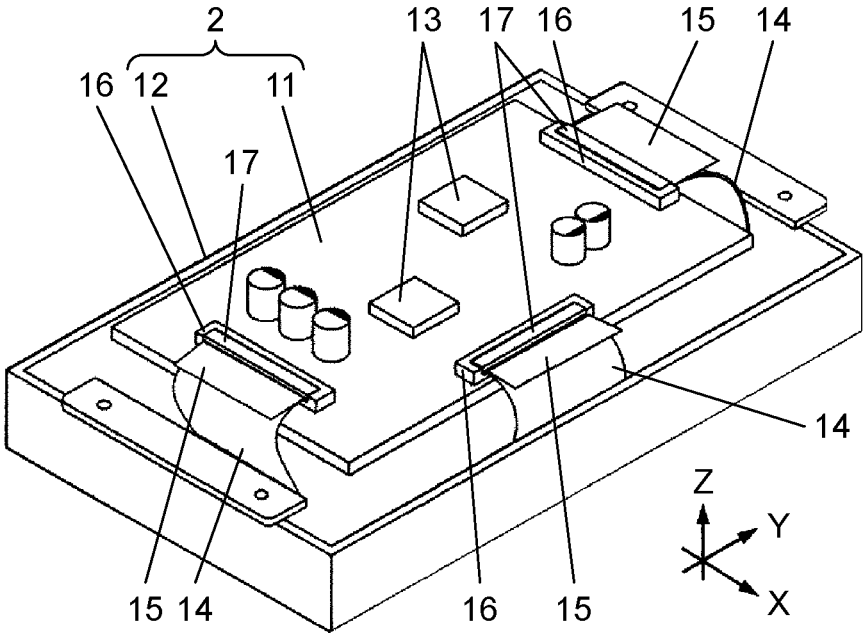
FIG. 2B is a perspective view illustrating an electronic device as a work target of the electronic device assembling apparatus according to the exemplary embodiment.

Electronic device 2 is, for example, an electronic device for use in vehicles, and mainly includes circuit board 11 and display device 12 as illustrated in FIGS. 2A and 2B. Electronic component 13 is installed on circuit board 11. Here, the display surface of display device 12 faces downward.

In FIGS. 2A and 2B, circuit board 11 and display device 12 each have a rectangular shape. Cable 14 made of a flexible printed board or the like is attached to each of three sides (two short sides and one long side) of the four sides included in display device 12. Cable 14 electrically connects circuit board 11 and display device 12. One end (lower end) side of cable 14 is previously connected to display device 12.

Figure 3:
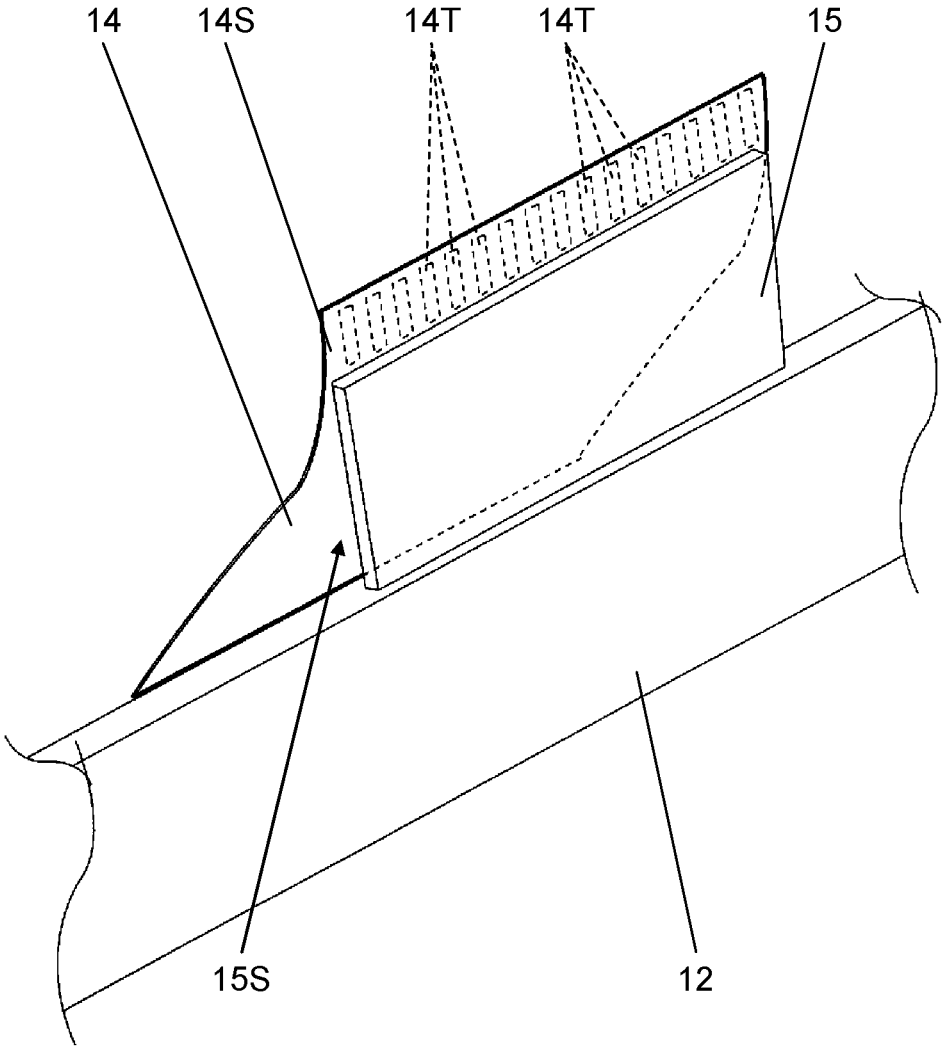
FIG. 3 is a schematic view illustrating a cable included in an electronic device as a work target of the electronic device assembling apparatus according to the exemplary embodiment.

In FIG. 2A, cable 14 before assembly extends upward from display device 12. A plurality of cable side terminals 14T are provided on the inner surface of tip portion (upper end portion) 14S of cable 14 (FIG. 3). Reinforcing plate 15 is provided on the outer surface of tip portion 14S of cable 14 (FIGS. 2A, 2B and FIG. 3).

In FIG. 3, reinforcing plate 15 is made of a thin plate member. One end side of reinforcing plate 15 is attached to tip portion 14S of cable 14. The other end side of reinforcing plate 15 extends to a base side (display device 12 side) of cable 14. Gap 15S is formed between the other end side of reinforcing plate 15 and cable 14.

Figure 4A:
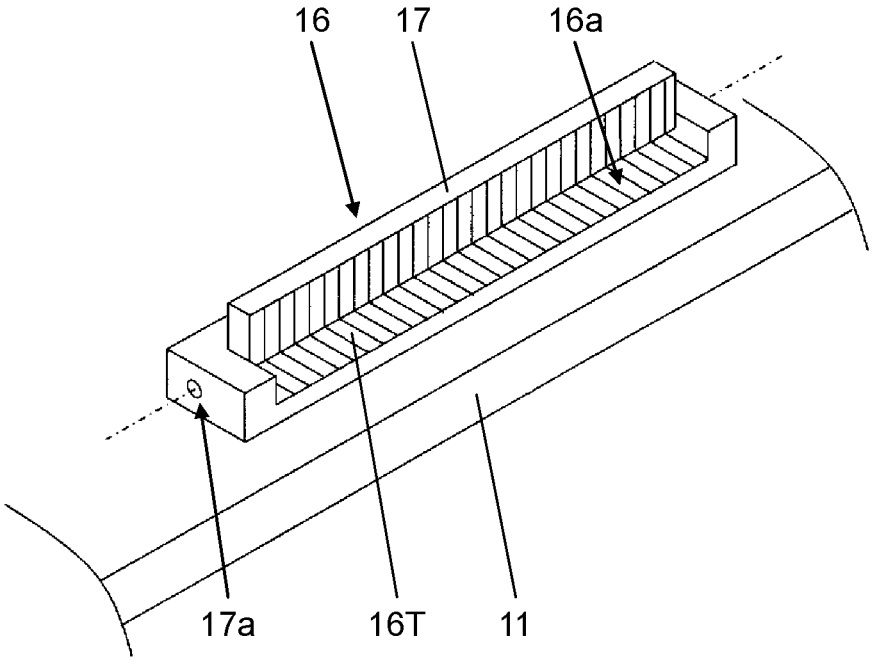
FIG. 4A is a perspective view illustrating a connector included in an electronic device as a work target of the electronic device assembling apparatus according to the exemplary embodiment.

In FIGS. 2A and 2B, among the four edge portions of the upper surface (installation surface) of circuit board 11, connector 16 into which tip portion 14S of cable 14 is inserted is provided in a portion corresponding to the three sides to which cable 14 of display device 12 is connected. As illustrated in FIG. 4A, connector 16 has cable receiver 16*a* into which tip portion 14S of cable 14 is inserted. On the upper surface of cable receiver 16*a*, there are provided a plurality of connector side terminals 16T which are in contact with a plurality of cable side terminals 14T included in cable 14.

Figure 4B:
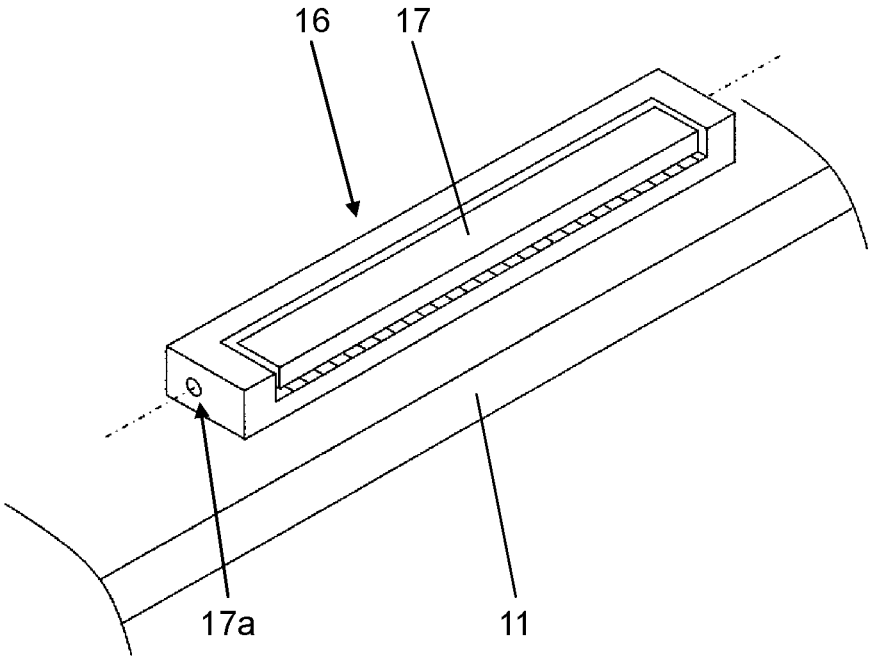
FIG. 4B is a perspective view illustrating a connector included in an electronic device as a work target of the electronic device assembling apparatus according to the exemplary embodiment.

In FIGS. 2A and 2B and FIGS. 4A and 4B, connector 16 is provided with locking member 17. Lock member 17 is formed of a door-like member provided so as to be swingable (open and close in up and down direction) about swing shaft 17*a* with respect to connector 16. Locking member 17 is in an opening posture in which tip portion 14S of cable 14 rises upward before being inserted into connector 16 (FIGS. 2A and 4A). Then, after tip portion 14S of cable 14 is inserted into connector 16, locking member is operated so as to lie down from the opening posture to a closing posture (FIGS. 2B and 4B). When lock member 17 is in the closing posture, tip portion 14S of cable 14 is pinched and locked between cable receiver 16*a* of connector 16 and lock member 17. As a result, cable 14 is prevented from falling off connector 16.

Next, electronic device assembling apparatus 1 will be described. In FIG. 1, electronic device assembling apparatus 1 has work stage 22 on base 21. Work stage 22 positions and holds electronic device 2 of a work target. Work stage 22 rotates about an up and down axis with respect to base 21, thereby positioning held electronic device 2 in a predetermined rotational posture.

Figure 5:
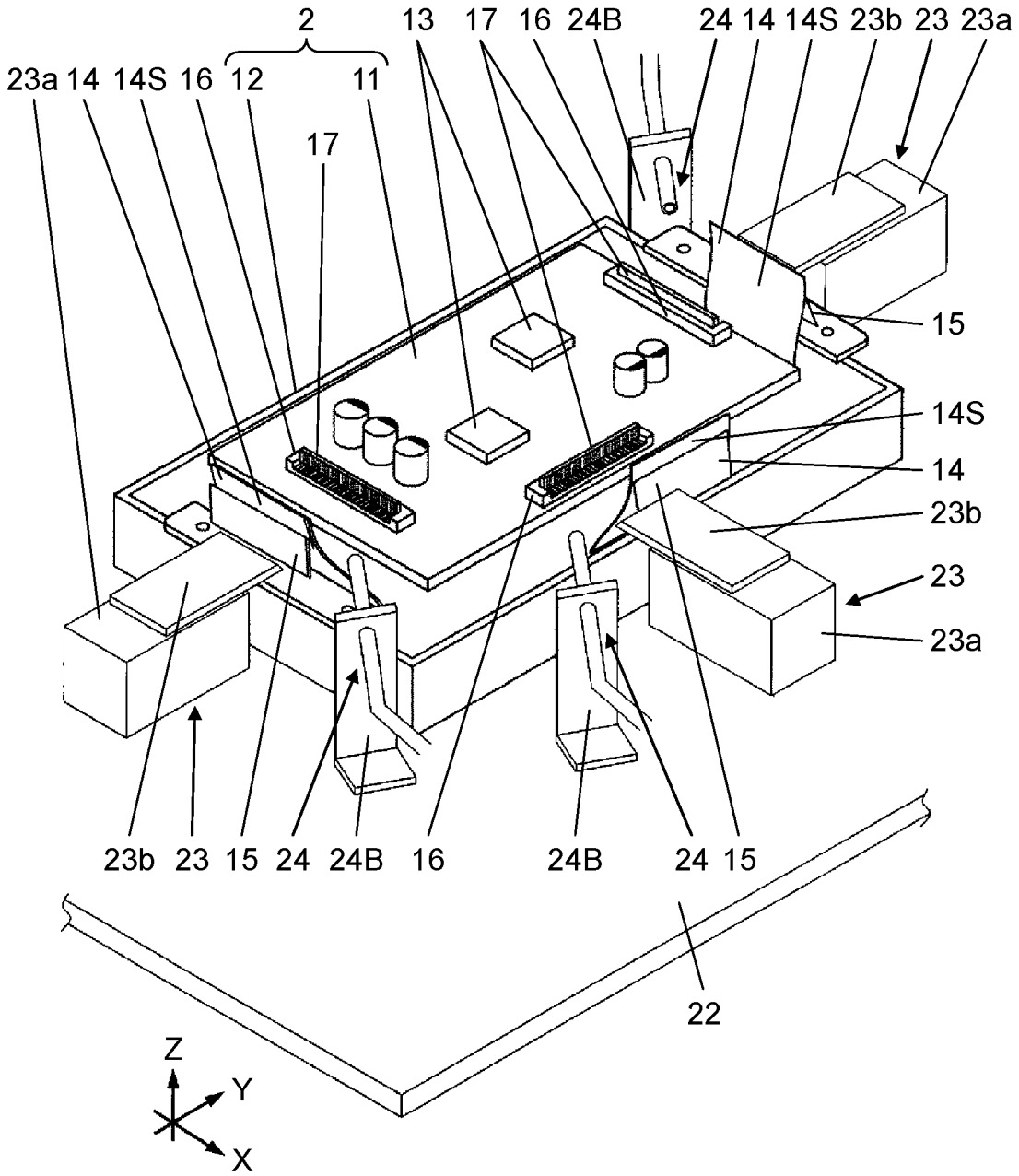
FIG. 5 is a diagram illustrating a work stage included in an electronic device assembling apparatus according to the exemplary embodiment, together with an electronic device as a work target.

In FIG. 5, a plurality (three in this case) of pushers 23 and a plurality (three in this case) of air blow nozzles 24 are provided at positions surrounding electronic device 2 on work stage 22. Pusher 23 is provided at a position opposite to the outer surface side (side on which reinforcing plate 15 is provided) of cable 14 included in electronic device 2. Air blow nozzle 24 is held by nozzle bracket 24B provided on work stage 22. Air blow nozzle 24 obliquely faces an air blow port with respect to lock member 17 of connector 16 included in electronic device 2.

In FIG. 1, a plurality of post members 25 extend upward from corners of base 21. The plurality of post members 25 support top panel 26 in a horizontal posture above base 21. Robot unit 27 and head portion 28 whose posture is changed by robot unit 27 are provided on the lower surface side of top panel 26. A touch panel 29 as an input/output device is provided on the side of top panel 26.

In FIG. 1, robot unit 27 includes fixed base 31, six link members 32, and moving base 33. Fixed base 31 is attached to a lower surface of top panel 26. Six link members 32 extend downward from fixed base 31. Moving base 33 is made of a plate-shaped member as a whole and has circular opening portion 33H at a center portion thereof (FIG. 6).

The lower ends of six link members 32 are coupled via universal joint 32*a* to a position surrounding opening portion 33H on the upper surface of moving base 33. Each of six link members 32 is individually operated by being driven by six servo mechanisms built in fixed base 31. By operating six link members 32 individually, it is possible to freely move moving base 33 with six degrees of freedom. In other words, in the exemplary embodiment, robot unit 27 is constituted by a parallel link robot.

Figure 6:
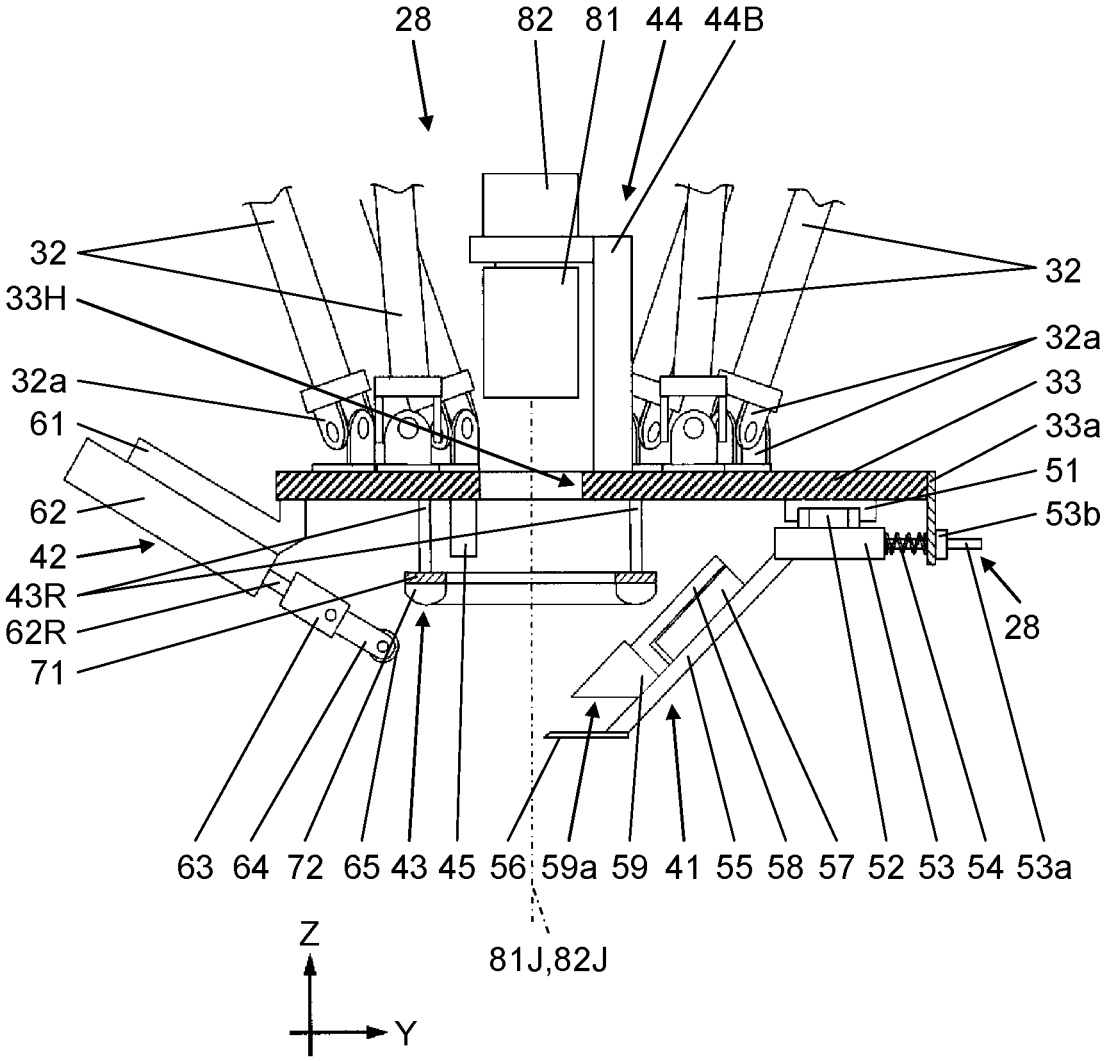
FIG. 6 is a side view illustrating a head portion included in the electronic device assembling apparatus according to the exemplary embodiment.

In FIG. 6, head portion 28 is provided on moving base 33. Head portion 28 includes cable holder 41, lock member operating unit 42, illumination unit 43, imaging unit 44, and lock unit opening/closing sensor 45. Cable holder 41, lock member operator 42, illuminating portion 43, and lock unit opening/closing sensor 45 are provided on the lower surface side of moving base 33. Imaging unit 44 is provided on the upper surface side of moving base 33.

Figure 7:
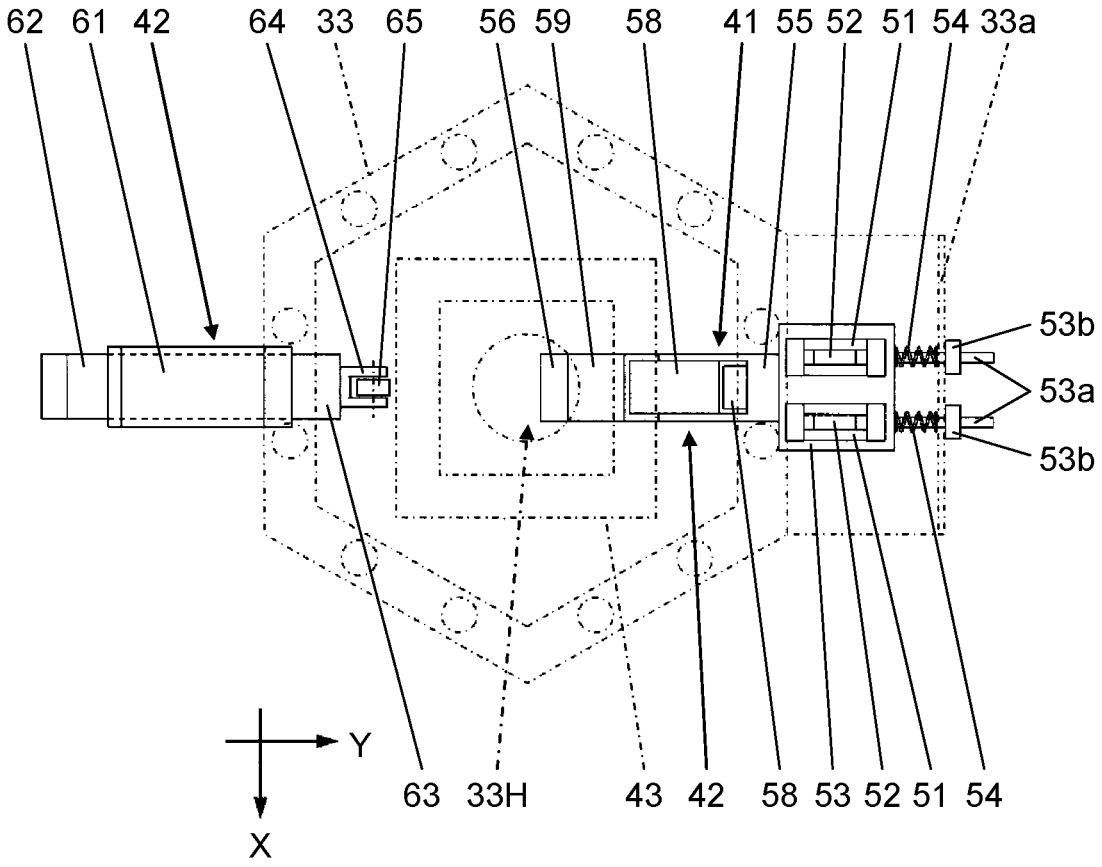
FIG. 7 is a perspective plan view illustrating a head portion included in the electronic device assembling apparatus according to the exemplary embodiment.

In FIGS. 6 and 7, cable holder 41 includes guide rail 51, slider 52, moving block 53, spring member 54, chuck base 55, blade 56, cable holder cylinder 57, slide unit 58 and chuck block 59. Guide rail 51 extends in the Y-axis direction on the lower surface of moving base 33 and guides slider 52 movably in the Y-axis direction. Moving block 53 is fixed to slider 52, and is guided by guide rail 51 and moves integrally with slider 52 in the Y-axis direction.

In FIGS. 6 and 7, screw portion 53*a* is provided extending in the Y-axis direction at an outer end portion of moving block 53 in the Y-axis direction (end portion on side away from center portion side of moving base 33). Screw portion 53*a* extends through a screw hole provided in downward extending portion 33*a* extending downward from moving base 33. Nut 53*b* is threadedly engaged with screw portion 53*a* at the end portion of downward extending portion 33*a* on a side where screw portion 53*a* penetrates.

In FIGS. 6 and 7, spring member 54 is provided between moving block 53 and downward extending portion 33*a*. Spring member 54 is a compression spring and urges moving block 53 toward the center of opening portion 33H of moving base 33. When nut 53*b* is twisted with respect to screw portion 53*a*, moving block 53 moves in the Y-axis direction.

In FIG. 6, chuck base 55 is attached to moving block 53. Chuck base 55 extends in an oblique direction in a YZ-plane passing through the center of opening portion 33H, and the tip portion thereof faces the position right under opening portion 33H. Blade 56 is made of a plate-shaped member and attached to the lower end of chuck base 55 in a horizontal posture. The tip portion of blade 56 is positioned below opening portion 33H.

In FIG. 6, cable holder cylinder 57 is provided on the upper surface of chuck base 55. Slide unit 58 is connected to a piston rod (not illustrated) of cable holder cylinder 57 and chuck block 59 is attached to the lower end of slide unit 58. Chuck block 59 has horizontal lower surface 59*a*. When cable holder cylinder 57 moves slide unit 58 along chuck base 55, lower surface 59*a* of chuck block 59 separates from the upper surface 56*a* of blade 56 (FIG. 8A) or approaches (FIG. 8B).

Figure 8A:
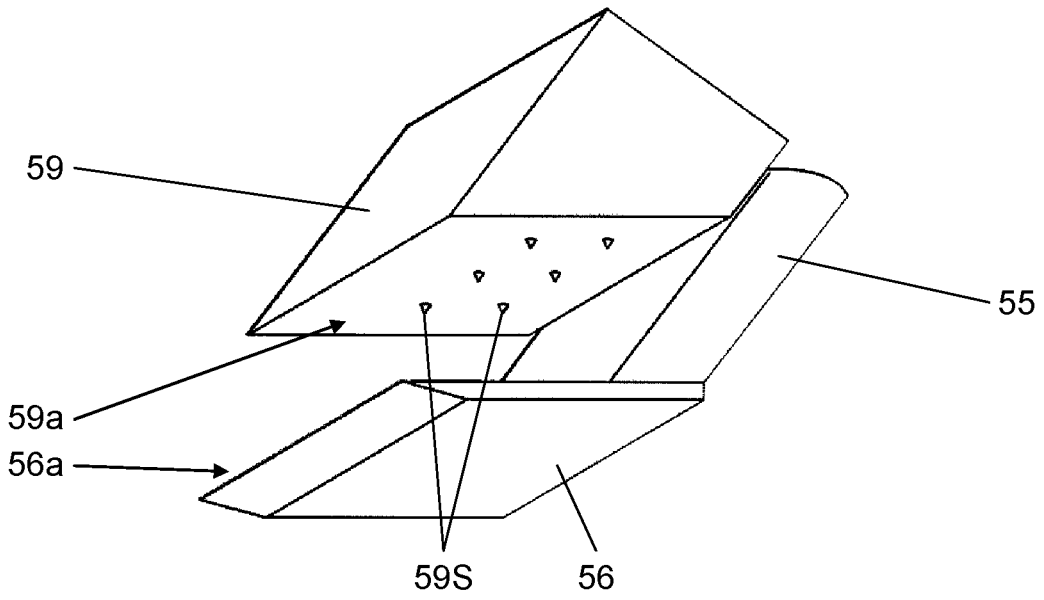
FIG. 8A is an explanatory diagram illustrating a configuration of a chuck block included in a head portion of an electronic device assembling apparatus according to the exemplary embodiment.
Figure 8B:
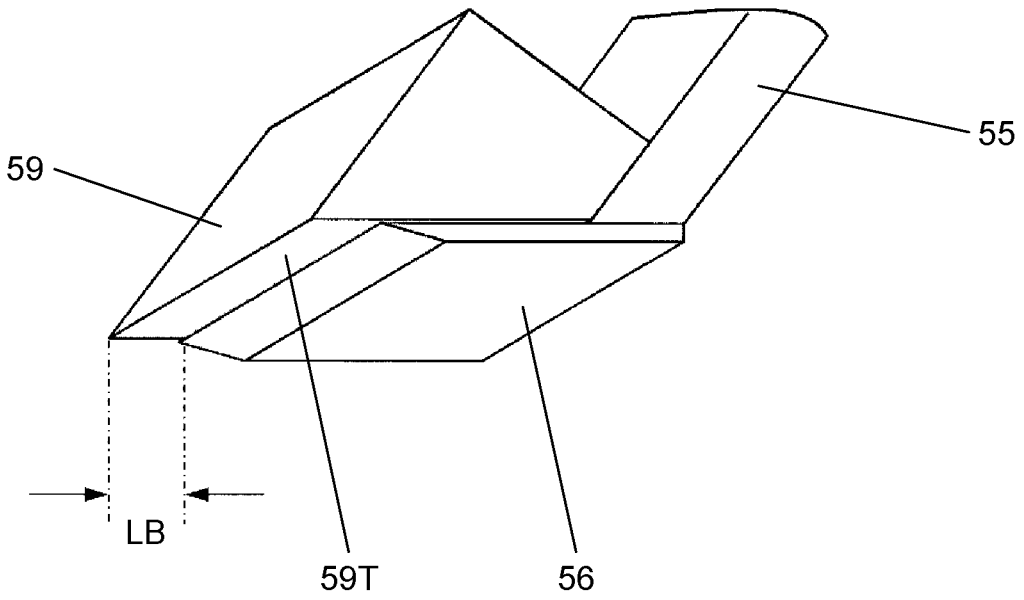
FIG. 8B is an explanatory diagram illustrating a configuration of a chuck block included in a head portion of an electronic device assembling apparatus according to the exemplary embodiment.

FIG. 8B illustrates a state where lower surface 59*a* of chuck block 59 is close to blade 56 (state where chuck block 59 is closed). In this state, the tip portion of lower surface 59*a* of chuck block 59 protrudes toward opening portion 33H from the tip portion of blade 56 to form protruding portion 59T having predetermined length LB. On the lower surface of chuck block 59, a plurality of spike claws 59S are provided (FIG. 8A).

When moving block 53 is moved in the Y-axis direction by twisting nut 53*b* with respect to screw portion 53*a*, the position of blade 56 approaches or separates from the lower position of opening portion 33H. Accordingly, the position of blade 56 below opening portion 33H can be adjusted as necessary.

In FIGS. 6 and 7, lock member operator 42 includes cylinder bracket 61, lock cylinder 62, buffer portion 63, roller support member 64, and roller 65. Cylinder bracket 61 is provided at a position facing cable holder 41 in the Y-axis direction across the center of opening portion 33H on the lower surface of moving base 33.

In FIG. 6, lock cylinder 62 is attached to the cylinder bracket 61. Lock cylinder 62 extends obliquely in the YZ-plane passing through the center of opening portion 33H, and the tip portion of piston rod 62R faces downward. Buffer portion 63 is attached to a tip portion (lower end portion) of piston rod 62R, and holds roller support member 64. Roller 65 is rotatably supported by roller support member 64.

Figure 9:
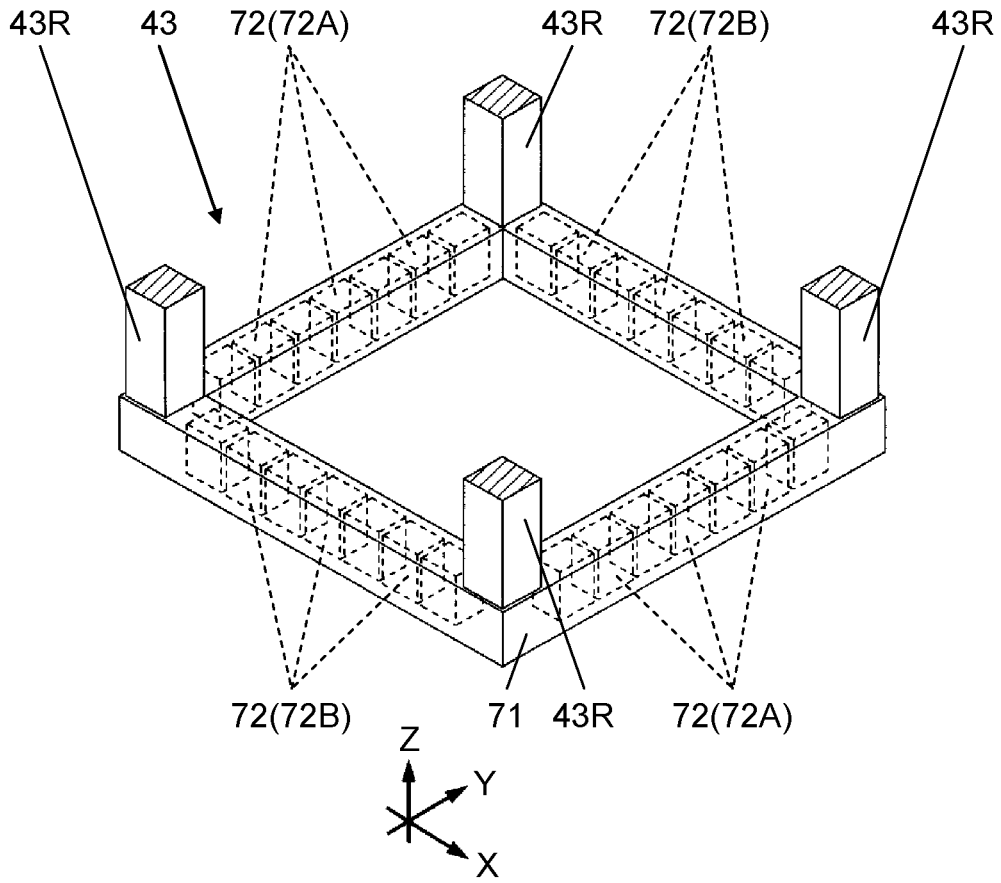
FIG. 9 is a perspective view of an illumination unit included in the electronic device assembling apparatus according to the exemplary embodiment.

In FIG. 6, illumination unit 43 is supported in a horizontal posture by a plurality of support members 43R that protrude and extend downward from the lower surface of moving base 33. As illustrated in FIG. 9, illumination unit 43 has frame 71 and a plurality of light emitting bodies 72 provided on the lower surface side of frame 71.

In FIG. 9, frame 71 has a rectangular shape having two sides parallel to the Y-axis direction and two sides orthogonal to these two sides (that is, parallel to X-axis) in a plan view. The center (center of rectangle) of frame 71 is positioned on the up and down axis passing through the center of opening portion 33H of moving base 33. The plurality of light emitting bodies 72 are made of, for example, an LED with the light emitting direction directed downward, and are arranged side by side along each side of the four sides of frame 71.

In FIG. 9, a plurality of light emitting bodies 72 includes a plurality of first light emitting bodies 72A disposed along two sides parallel to the Y-axis of a frame 71, and a plurality of second light emitting bodies 72B disposed along two sides parallel to the X-axis of frame 71. Illumination unit 43 illuminates the illumination target object positioned below illumination unit 43 by causing light emitting body 72 to emit light. Light emitting bodies 72 can independently turn on and off and adjust illuminance and the illuminance of first light emitting body 72A and the illuminance of second light emitting body 72B can be made different from each other.

In FIG. 6, imaging unit 44 includes optical lens unit 81 and camera 82 as an imaging means. Imaging unit bracket 44B is provided on the upper surface of moving base 33 so as to extend upward, and optical lens unit 81 and camera 82 are attached to imaging unit bracket 44B. Camera 82 is positioned above optical lens unit 81, and imaging optical axis 82J of camera 82 extends in the up and down direction through the center of opening portion 33H. Optical axis 81J of optical lens unit 81 also extends in the up and down direction and coincides with imaging optical axis 82J of camera 82.

Camera 82 images an imaging target through optical lens unit 81 in a state where the imaging target positioned below optical lens unit 81 is illuminated by illumination unit 43. In the exemplary embodiment, the imaging target imaged by camera 82 is tip portion 14S of cable 14 and connector 16 as described below.

In FIG. 6, lock unit opening/closing sensor 45 is provided at a position close to opening portion 33H on the lower surface of moving base 33. Lock unit opening/closing sensor 45 includes a distance measuring sensor that irradiates measurement light downward. Locking unit opening/closing sensor 45 has a light projector for projecting the measurement light downward and a light receiver for receiving the reflected measurement light (reflected light). Lock unit opening/closing sensor 45 irradiates the measurement light toward connector 16 (FIG. 10) and receives the reflected light thereof, thereby detecting the opening/closing state of lock member 17 provided in connector 16.

Figure 11A:
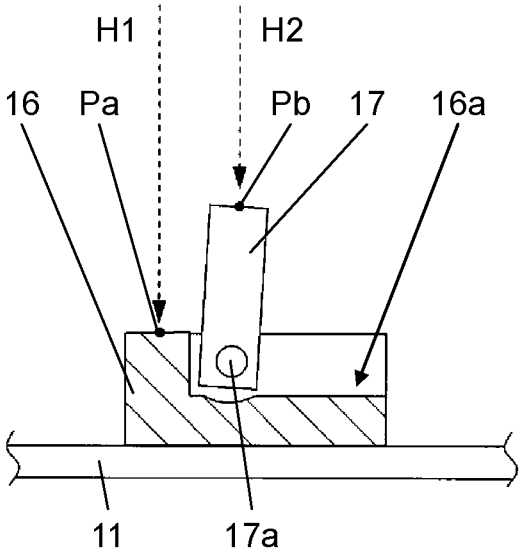
FIG. 11A is a view for explaining the principle of confirming opening and closing posture of a connector included in an electronic device assembling apparatus according to the exemplary embodiment.
Figure 11B:
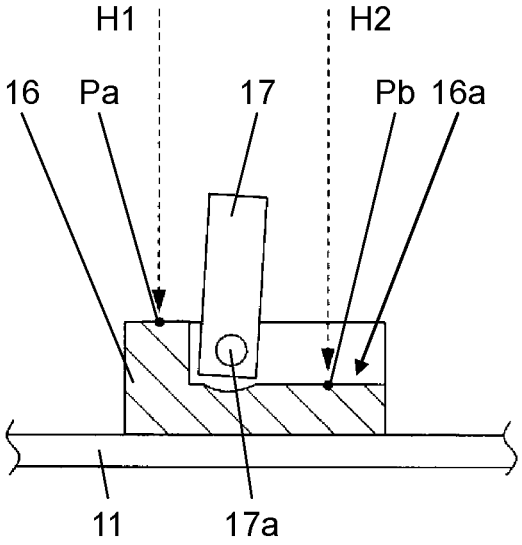
FIG. 11B is a view for explaining the principle of confirming opening and closing posture of a connector included in an electronic device assembling apparatus according to the exemplary embodiment.

Specifically, as illustrated in FIGS. 11A and 11B, first, height H1 of the measurement position (first measurement position Pa) whose height does not change regardless of the opening/closing posture of lock member 17 and height H2 of the measurement position (second measurement position Pb) whose height changes according to the opening/closing posture of lock member 17 are obtained. Then difference ΔH (=H1·H2) between these heights is calculated, and the calculated difference ΔH is compared with a predetermined reference value ΔH0 to detect the opening/closing posture of lock member 17.

In the exemplary embodiment, for example, first measurement position Pa is set on the upper surface of connector 16 and second measurement position Pb is set on the upper surface of lock member 17 (FIG. 11A) or the upper surface of cable receiver 16*a* of connector 16 (FIG. 11B). For example, reference value ΔH0 is set to a value intermediate between difference ΔH obtained when lock member 17 is in the closing posture and difference ΔH obtained when lock member 17 is in the opening posture. In this case, if calculated difference ΔH is smaller than reference value ΔH0, it is detected that lock member 17 is in the opening posture. When calculated difference ΔH is larger than reference value ΔH0, it is detected that lock member 17 is in the closing posture.

In FIG. 5, pusher 23 has pusher base 23*a* provided on the upper surface of work stage 22 and movable piece 23*b* movable in the horizontal direction with respect to pusher base 23*a*. An actuator (for example, a cylinder) for operating movable piece 23*b* is incorporated in pusher base 23*a*. Air blow nozzle 24 blows air to lock member 17 before cable 14 is inserted into connector 16 by cable holder 41.

Figure 12:
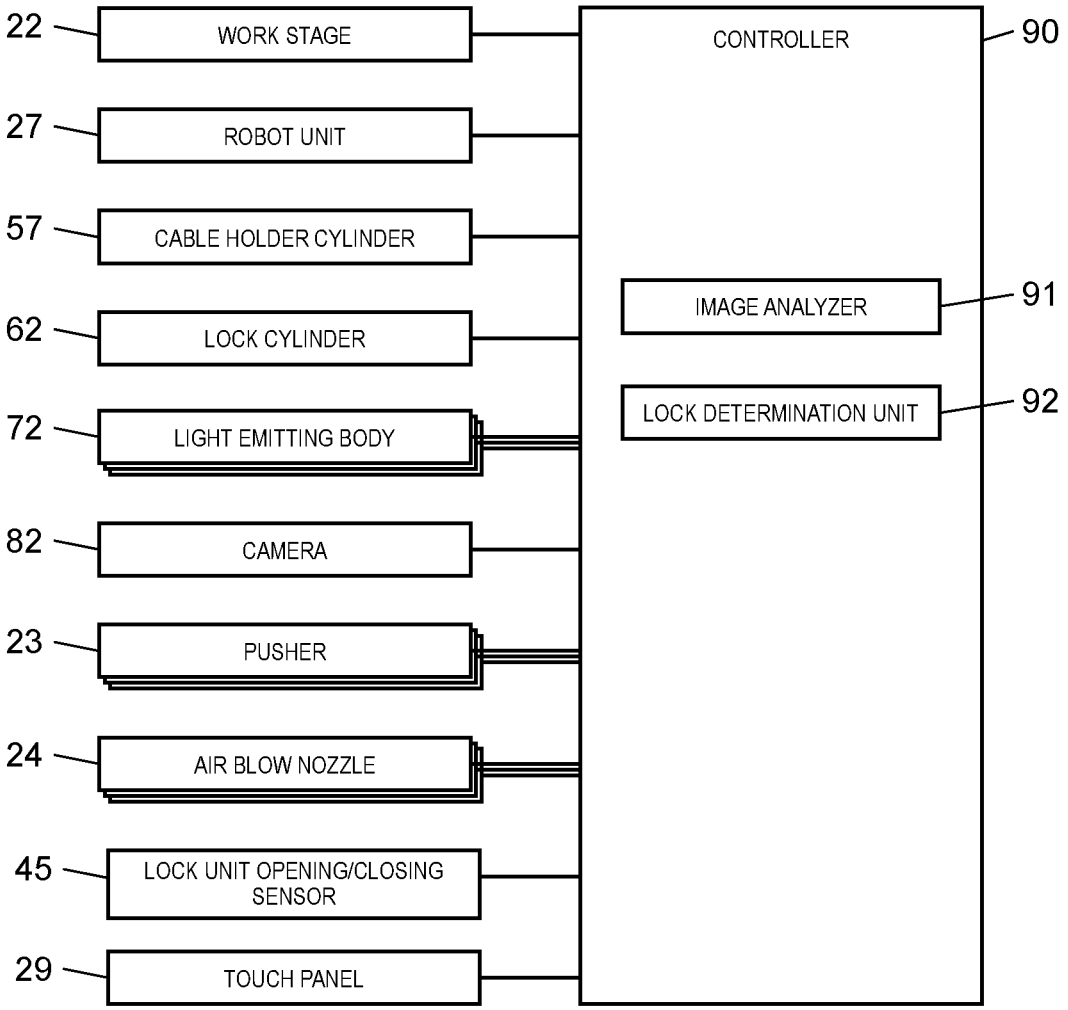
FIG. 12 is a block diagram illustrating a control system of the electronic device assembling apparatus according to the exemplary embodiment.

In FIG. 12, controller 90 of electronic device assembling apparatus 1 controls a positioning operation of electronic device 2 by work stage 22, a movement and a posture changing the operation of head unit 28 by robot unit 27, an operation of cable holder cylinder 57 included in cable holder 41. Further, controller 90 controls an operation of lock cylinder 62 included in lock member operator 42, a light emission (illuminance adjustment) operation of light emitting body 72 included in illumination unit 43, and an imaging operation of camera 82 of imaging unit 44. In addition, controller 90 controls operating movable piece 23*b* of each of the plurality of pushers 23 and control to blow air from each of the plurality of air blow nozzles 24.

In FIG. 12, analysis based on an image (captured image) obtained by imaging by camera 82 is performed by image analyzer 91 of controller 90. Lock determination unit 92 of controller 90 performs determination of opening or closing of lock member 17 of connector 16 based on the detection information of lock unit opening/closing sensor 45. Information input from touch panel 29 is input to controller 90, and controller 90 outputs information to the worker through touch panel 29.

Next, with reference to the flow chart illustrated in FIG. 13, the procedure of executing the cable installation operation including the insertion of cable 14 into connector 16 by electronic device assembling apparatus 1 in the exemplary embodiment and the lock operation will be described. Here, an example in which one cable 14 is installed on the corresponding connector 16 will be described. However, the same operation is performed when another cable 14 is installed on corresponding connector 16. Before the cable installation work is performed, work stage 22 holds electronic device 2 as a work target in advance. At this time, lock members 17 of all connectors 16 included in electronic device 2 are brought into the opening posture.

Figure 13:
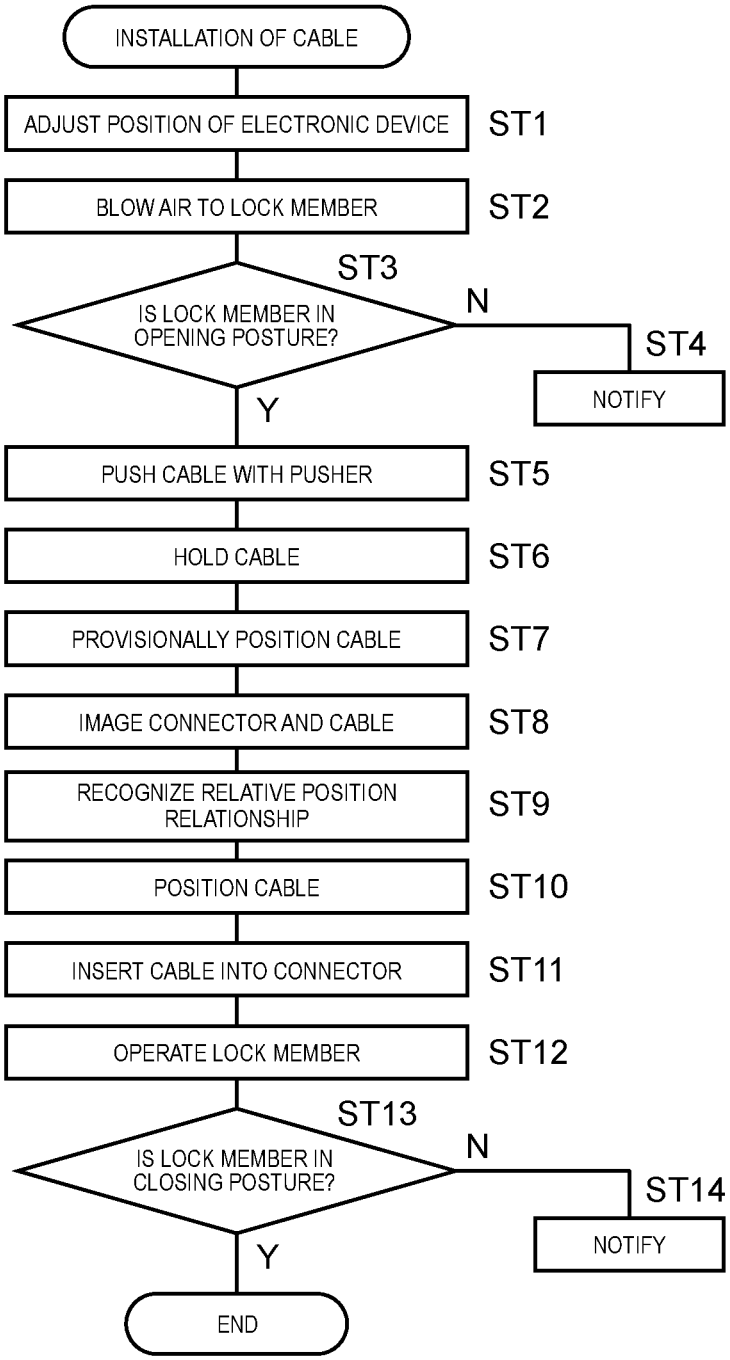
FIG. 13 is a flowchart illustrating a flow of a cable installation operation executed by the electronic device assembling apparatus according to the exemplary embodiment.

In the cable installation operation, first, the position of electronic device 2 is adjusted (electronic device position adjusting step in step ST1 illustrated in FIG. 13). Specifically, work stage 22 is operated, and the outer surface (surface on which reinforcing plate 15 is installed) of cable 14 which is about to be inserted into connector 16 from now rotates around the up and down axis so as to face the tip portion of chuck block 59.

Figure 14:
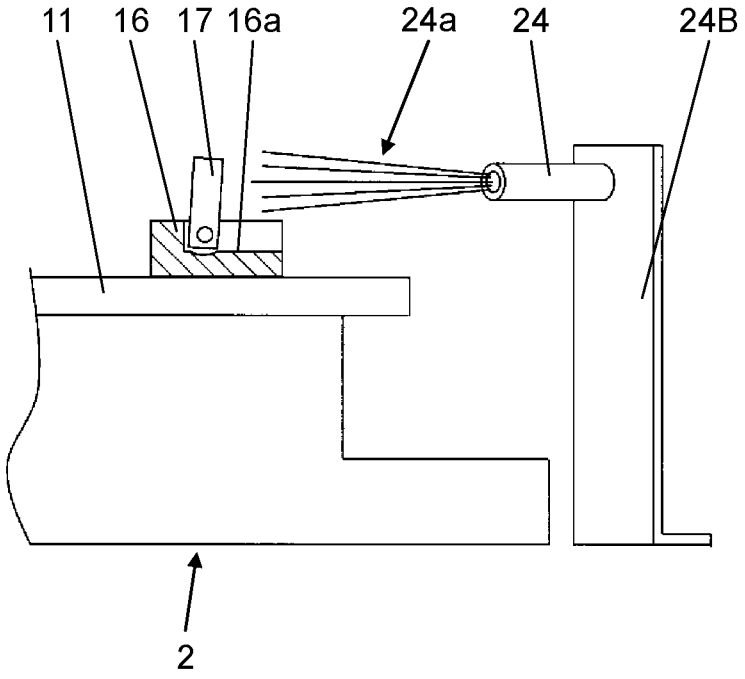
FIG. 14 is a view illustrating a state where the air is blown toward a lock member from an air blow nozzle included in the electronic device assembling apparatus according to the exemplary embodiment.

After the position adjustment of electronic device 2 is performed, as illustrated in FIG. 14, air blow nozzle 24 provided corresponding to connector 16 as an insertion target of cable 14 blows air 24*a* toward lock member 17 of connector 16 for a predetermined time (air blow step of step ST2). Accordingly, even if lock member 17 is in the half open state, lock member 17 is set in the opening posture.

Figure 10:
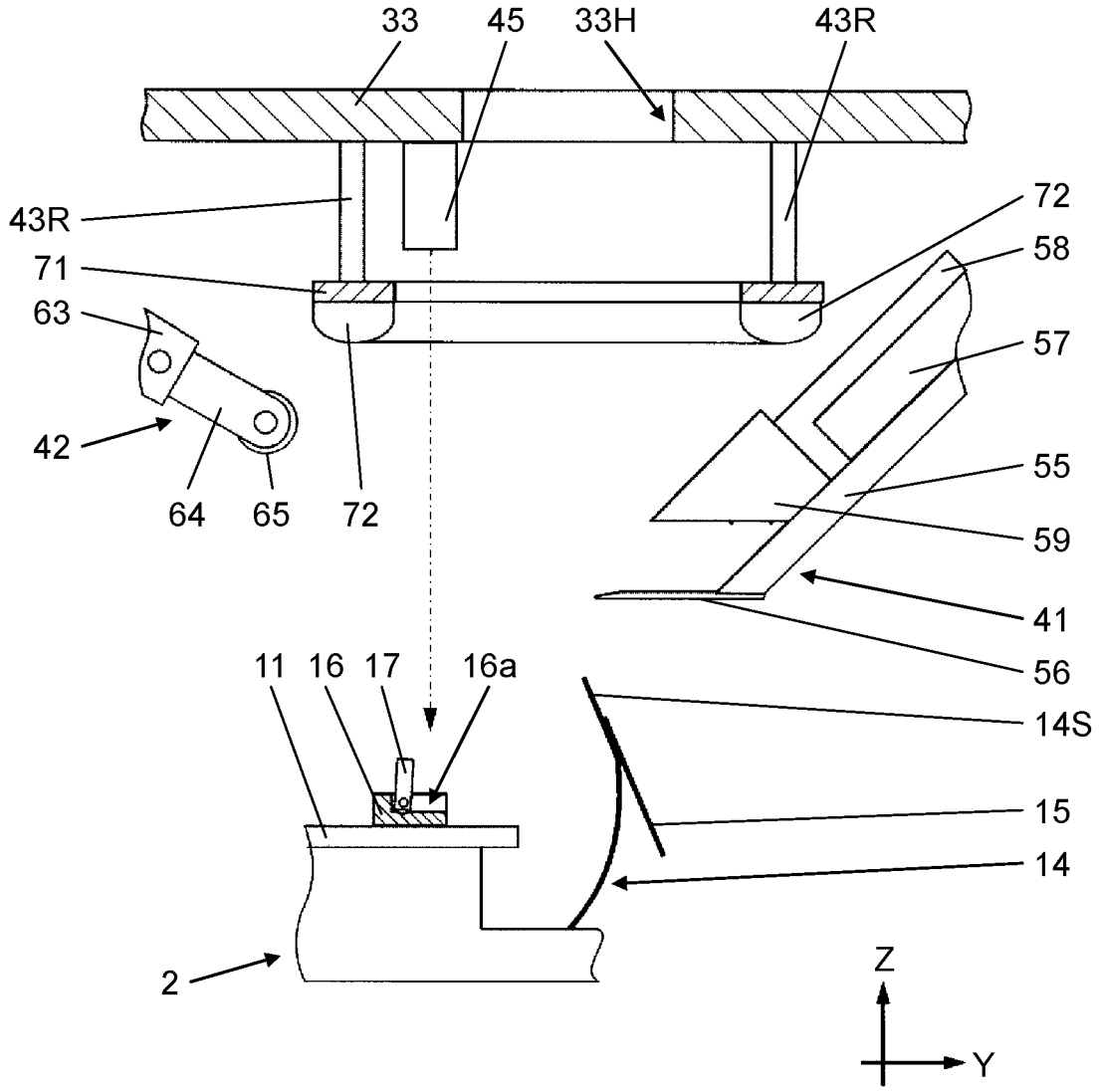
FIG. 10 is a side view in the vicinity of an illumination unit included in the electronic device assembling apparatus according to the exemplary embodiment.

When air is blown to locking member 17, locking unit opening/closing sensor 45 inspects whether or not locking member 17 of connector 16, as an insertion target of cable 14, is in the opening posture (in opening posture inspecting step of step ST3). Specifically, robot unit 27 moves head unit 28 to position locking unit opening/closing sensor 45 above connector 16 (FIG. 10). Then, as described above, by irradiating the measurement light from locking unit opening/closing sensor 45 toward connector 16 and receiving the reflected light thereof, the opening/closing state of locking member 17 provided in connector 16 is detected.

As a result of inspecting whether or not lock member 17 is in the opening posture, in a case where lock member 17 was not in the opening posture (in closing posture), the work is temporarily stopped and then, through touch panel 29, the fact that lock member 17 is closed is notified (notification step in step ST4). A worker who received this notification manually opens lock member 17 and performs an operation to resume the work from touch panel 29.

In a case where it is detected that lock member 17 is in the opening posture in the opening posture inspecting step or in a case where the operation for resuming work is performed from the touch panel 29 after it is detected that lock member 17 is in the closing posture in the opening posture inspecting step, the cable pressing step (step ST5) is executed. In the cable pressing step, cable 14 is pressed by pusher 23 so that cable 14 is in a posture that is easily held by cable holder 41. Specifically, pusher 23 positioned at a position facing connector 16 as an insertion target of cable 14 causes movable piece 23*b* to protrude toward the side of cable 14 (FIG.

Figure 15A:
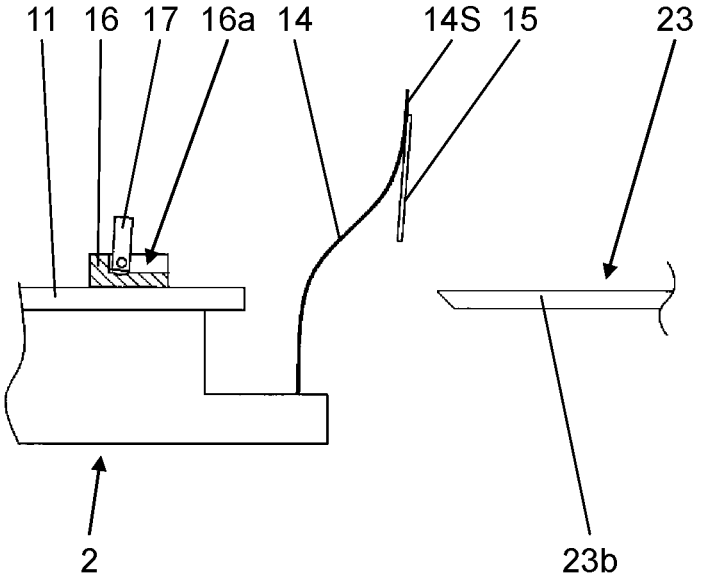
FIG. 15A is a view illustrating a state where a cable is pressed by a pusher included in the electronic device assembling apparatus according to the exemplary embodiment.
Figure 15B:
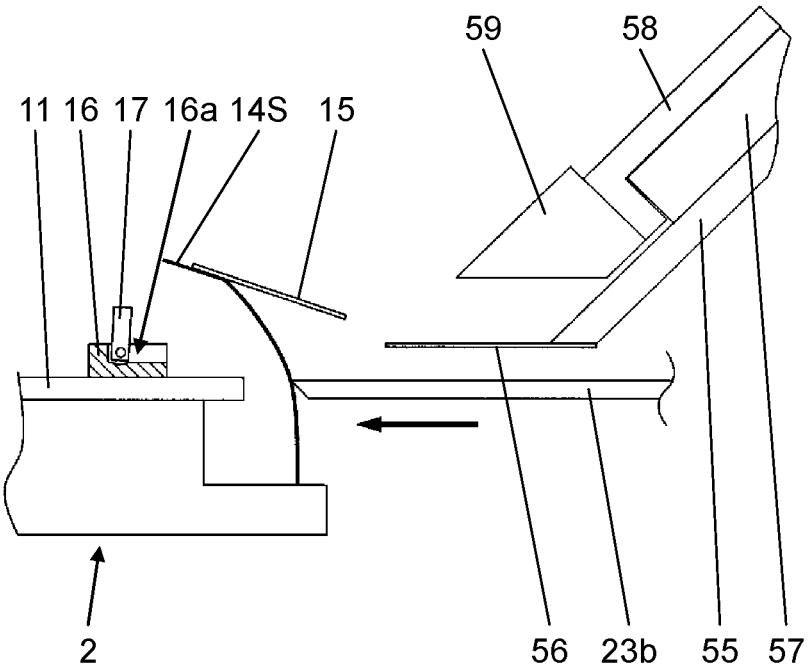
FIG. 15B is a view illustrating a state where a cable is pressed by a pusher included in the electronic device assembling apparatus according to the exemplary embodiment.

15A→FIG. 15B). Accordingly, since the intermediate portion of cable 14 is pressed toward the side of connector 16 by movable piece 23*b* and the posture is changed so that the head of the upper end portion (tip portion) is lowered (FIG. 15B), cable holder 41 is likely to hold cable 14. At this time, pusher 23 continues to press cable 14 until the cable holding step described below is completed.

Figure 16A:
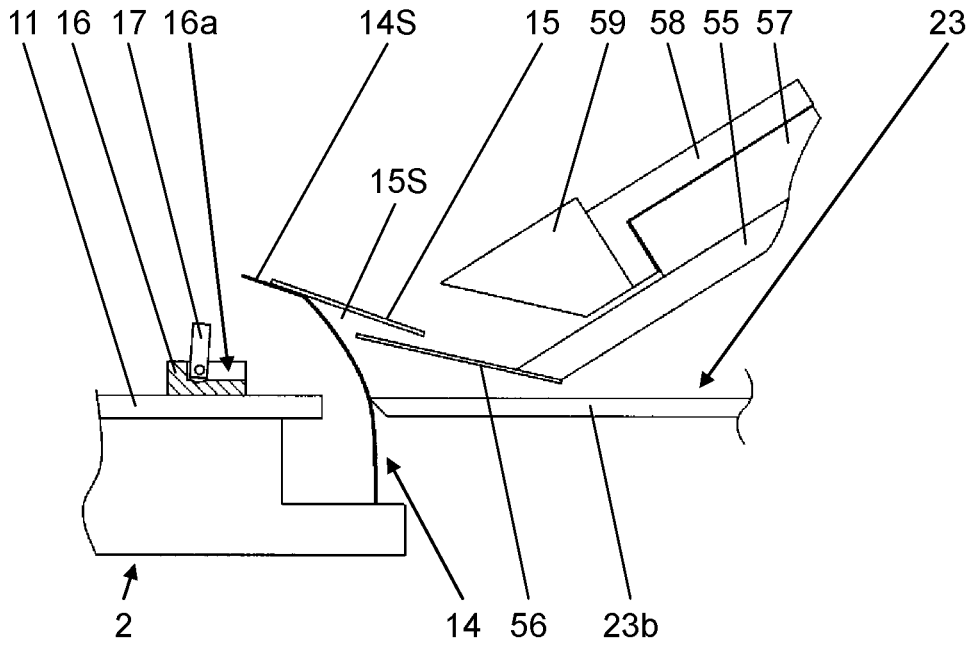
FIG. 16A is an operation explanatory diagram of a cable holder included in the electronic device assembling apparatus according to the exemplary embodiment.
Figure 16B:
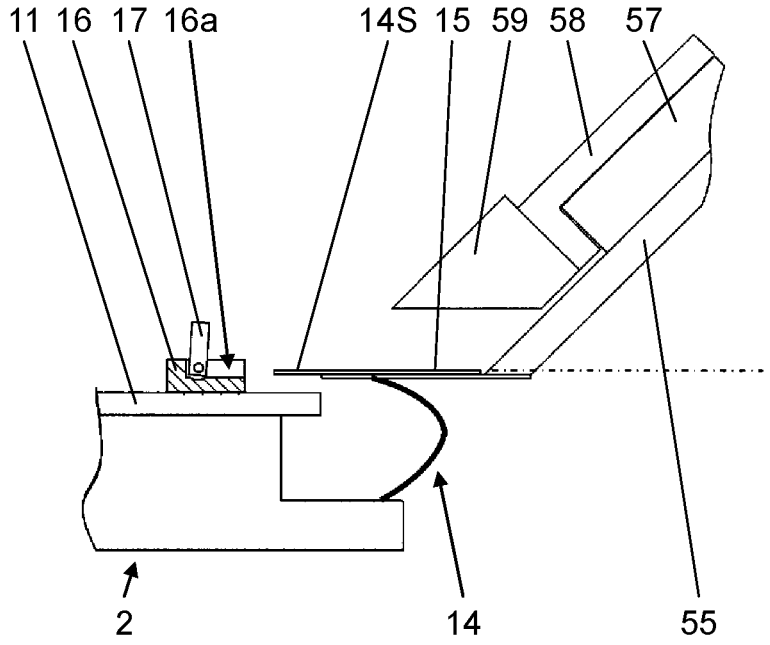
FIG. 16B is an operation explanatory diagram of a cable holder included in the electronic device assembling apparatus according to the exemplary embodiment.
Figure 17A:
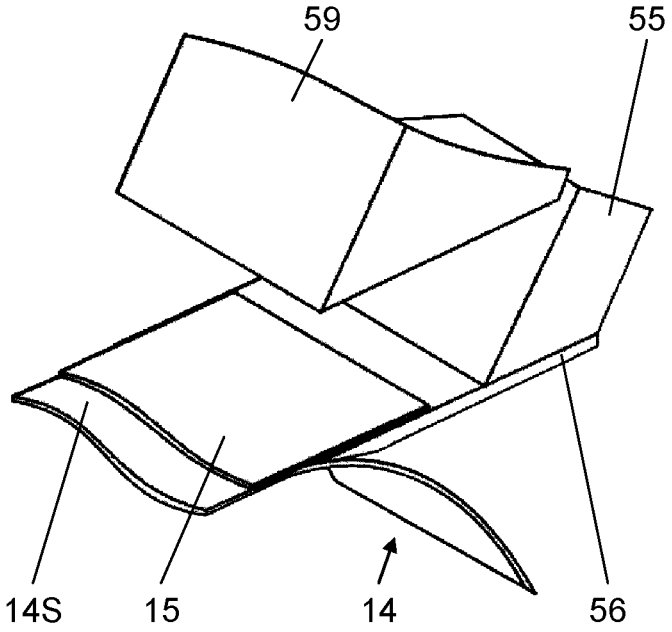
FIG. 17A is a view illustrating a state of holding a cable by a cable holder of an electronic device assembling apparatus according to the exemplary embodiment.
Figure 17B:
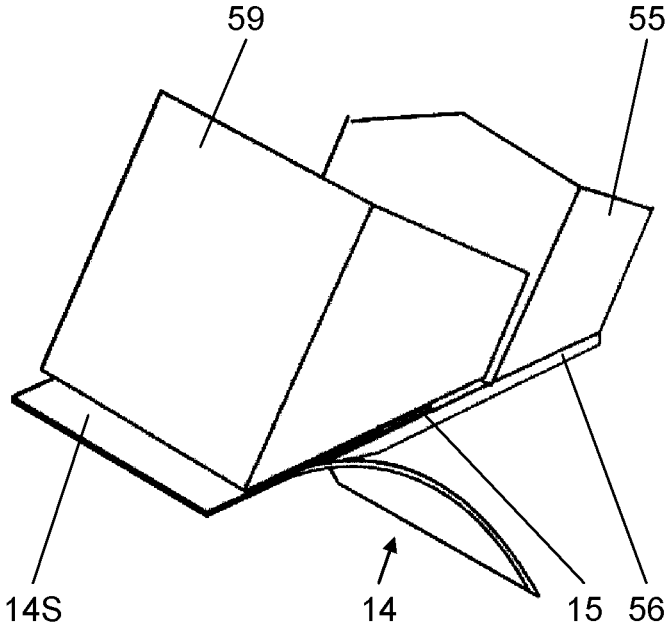
FIG. 17B is a view illustrating a state of holding a cable by a cable holder of an electronic device assembling apparatus according to the exemplary embodiment.

When cable 14 is pressed by pusher 23, robot unit 27 moves head unit 28 to hold cable 14 in cable holder 41 (cable holding step in step ST6). Specifically, cable holder 41 operates to insert blade 56 into gap 15S between cable 14 and reinforcing plate 15 and scoop up (FIG. 16A→FIG. 16B). Then, chuck block 59 is brought close to blade 56 (FIG. 17A→FIG. 17B), and reinforcing plate 15 is interposed between upper surface 56*a* of blade 56 and lower surface 59*a* of chuck block 59 to hold cable 14. Accordingly, tip portion 14S of cable 14 is in a state of protruding from the distal end of chuck block 59 (FIG. 17B).

Here, as described above, before cable holder 41 holds cable 14, pusher 23 presses cable 14 so that cable 14 is in a posture that is likely to be held by cable holder 41.

Therefore, the occurrence of holding mistake of cable 14 by cable holder 41 is unlikely to occur.

When cable holder 41 holds cable 14 in the cable holding step, a plurality of spike claws 59S provided on lower surface 59*a* of chuck block 59 bites slightly into the surface of reinforcing plate 15. Therefore, a slip of reinforcing plate 15 with respect to chuck block 59 is prevented, and reinforcing plate 15 is firmly held by blade 56 and chuck block 59. Here, when cable 14 is caught between chuck block 59 and blade 56 together with reinforcing plate 15, even in a case where cable 14 is deformed such as a warped shape and a wavy shape, the deformation thereof is corrected.

Figure 18:
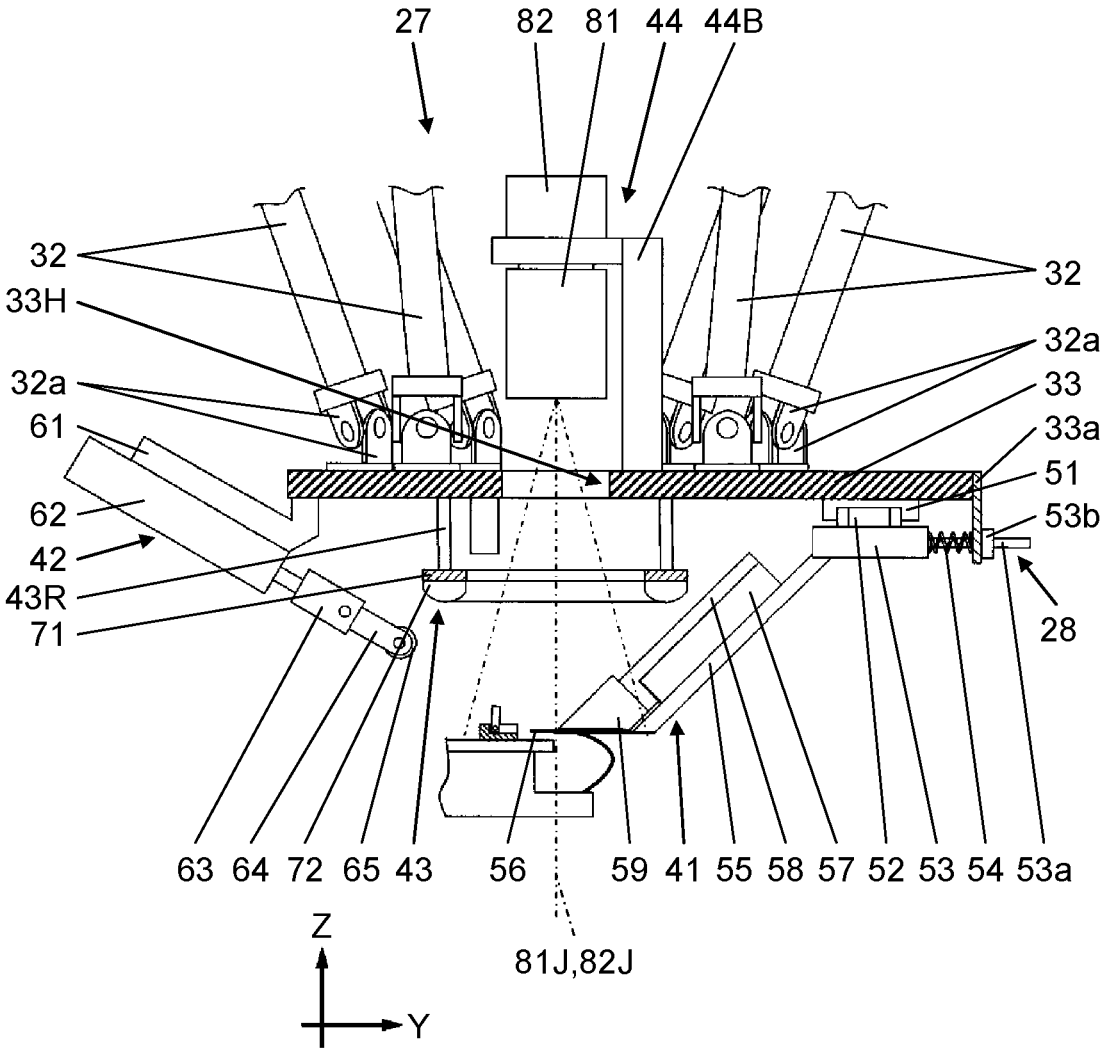
FIG. 18 is a view illustrating a state where a cable held by a cable holder is imaged together with a connector by a camera included in the electronic device assembling apparatus according to the exemplary embodiment.

When cable holder 41 holds cable 14 as described above, cable 14 is provisionally positioned with respect to connector 16 (provisional positioning step in step ST7). In the temporary positioning of cable 14, robot unit 27 moves head unit 28 so that tip portion 14S of cable 14 approaches connector 16 in a horizontal posture. Then, both tip portion 14S of cable 14 and connector 16 are positioned within an image capturing area of camera 82 (FIG. 18).

Figure 19:
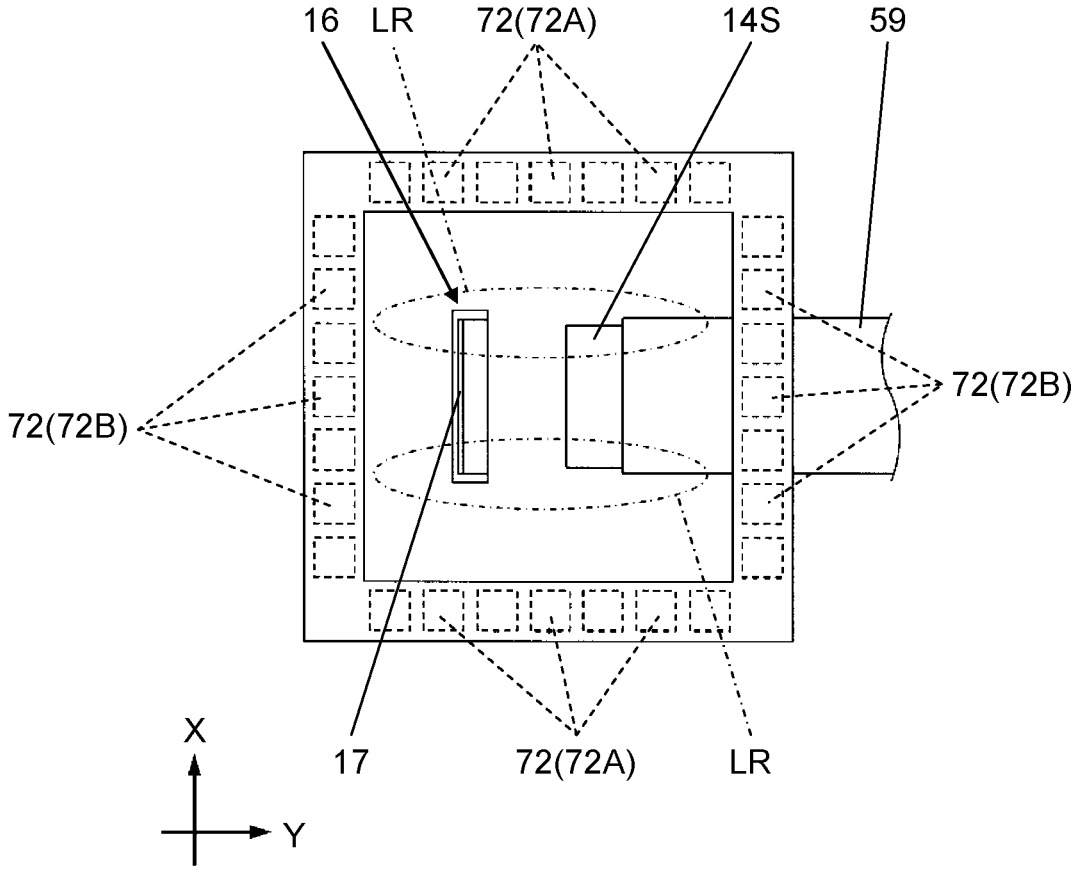
FIG. 19 is a plan view illustrating a state where a cable and a connector are illuminated by an illumination unit included in the electronic device assembling apparatus according to the exemplary embodiment.

When cable 14 is temporarily positioned with respect to connector 16 as described above, illumination unit 43 illuminates cable 14 held by cable holder 41, and camera 82 images connector 16 together with cable 14 under the illumination of illumination unit 43 (imaging step in step ST8). When illumination unit 43 illuminates in the imaging step, first light emitting body 72A emits light with a relatively high illuminance than second light emitting body 72B. Therefore, the two side edges of cable 14 passing through region LR (FIG. 19) parallel to the arrangement direction (Y-axis direction) of first light emitting body 72A (side edges of cable 14 parallel to the insertion direction with respect to connector 16) is illuminated brighter than other areas, and the edges thereof can be accurately recognized.

As described above, in the exemplary embodiment, in the imaging step, illumination unit 43 illuminates the cable so that the side edge of cable 14 parallel to the insertion direction with respect to connector 16 is relatively brighter than the other portion of cable 14.

Under the illumination by illumination unit 43 as described above, camera 82 images connector 16 and tip portion 14S of cable 14. When camera 82 images connector 16 and cable 14, controller 90 recognizes the relative positional relationship between tip portion 14S of cable 14 and connector 16 based on the captured image (recognition step in step ST9).

Figure 20:
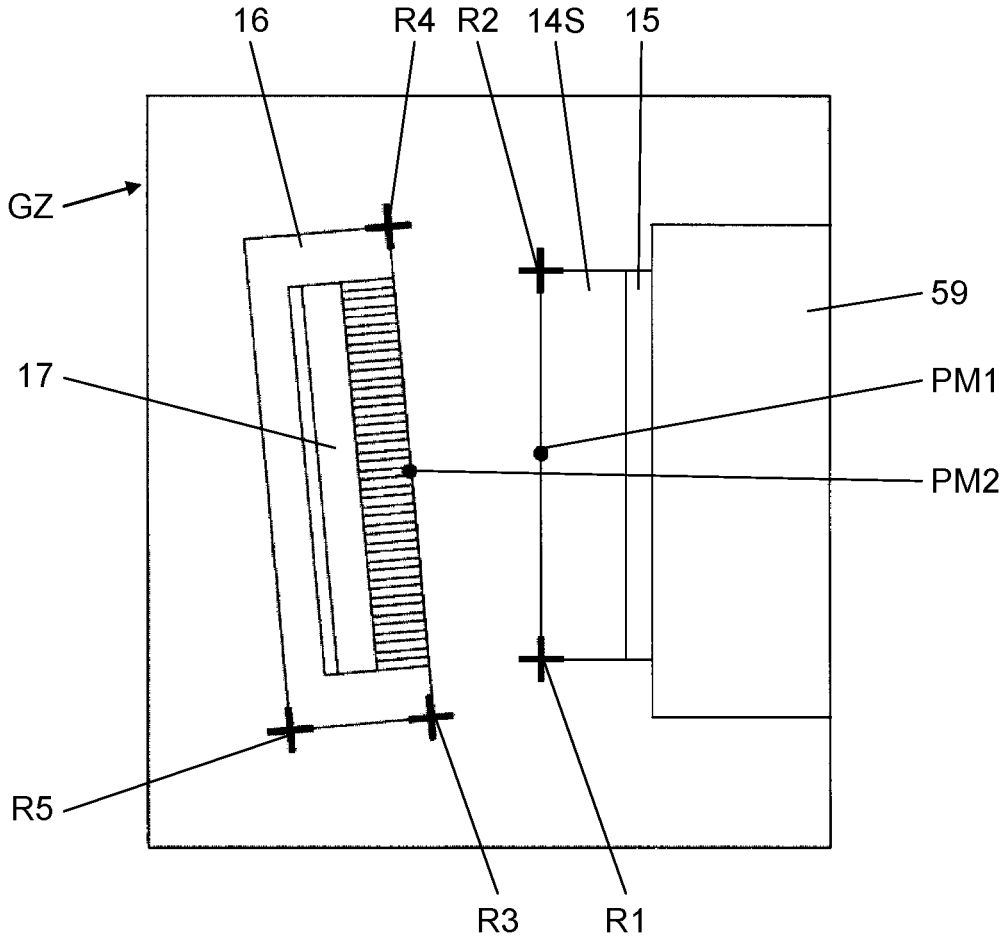
FIG. 20 is a diagram illustrating an example of a captured image acquired by a camera included in the electronic device assembling apparatus according to the exemplary embodiment.

FIG. 20 illustrates an example of an image (referred to as captured image GZ) obtained in the imaging step. In captured image GZ, together with the tip portion of chuck block 59 of cable holder 41 and tip portion 14S of cable 14 held by chuck block 59, connector 1*b* before cable installation in a state where lock member 17 is in the opening posture is illustrated. Since the positional relationship between camera 82 and chuck base 55 is fixed and chuck block 59 moves only in the Y-axis direction in a plan view along chuck base 55, the orientation of chuck block 59 in captured image GZ is always constant.

On the other hand, the orientation of cable 14 held by cable holder 41 and the orientation of connector 16 are not constant with respect to captured image GZ. Therefore, when inserting cable 14 into connector 16, the relative positional relationship between cable 14 and connector 16 is acquired based on obtained captured image GZ, and it is necessary to perform formal positioning (positioning of cable 14 with respect to connector 16) so that the position of tip portion 14S of cable 14 with respect to connector 16 becomes a predetermined positional relationship.

In the example illustrated in FIG. 20, the positions of two locations (R1 and R2) at the corners of tip portion 14S of cable 14 are recognized as the recognition points on a side of cable 14. In addition, the positions of two locations (R3 and R4) on the corner portion of connector 16 facing cable 14 and the position of one location (R5) on the rear corner portion of one (R3) of two portions are recognized as recognition points of connector 16. The intermediate position between two recognition points (R1 and R2) on a side of cable 14 is obtained as the position of the representative point (cable-side representative point PM1) on the side of cable 14. In addition, the intermediate position between recognition points (R3 and R4) on a side of connector 16 is obtained as the position of the representative point (connector-side representative point PM2) on the side of connector 16. Further, the orientation of connector 16 (direction around Z-axis) is obtained from the positions of two recognition points (R3 and R5) on the side of connector 16.

In the imaging step in which camera 82 images cable 14 and connector 16, as described above, first light emitting body 72A of illumination unit 43 emits light with a relatively high illuminance than second light emitting body 72B. Therefore, cable 14 is illuminated so that the two sides of cable 14 parallel to the insertion direction with respect to connector 16 are brighter than the other portions. As a result, it is possible to accurately recognize the positions of two recognition points (R1 and R2) at the corners of tip portion 14S of cable 14, which is relatively difficult to detect. In addition, in the imaging step, since connector 16 is in a state of facing tip portion 14S of cable 14, the positions of the three recognition points (R3, R4, and R5) on the side of connector 16 can also be accurately recognized.

As described above, the position of the cable-side representative point PM1, the position of the connector-side representative point PM2, and the orientation of connector 16 are recognized. Thereafter, cable 14 is positioned with respect to connector 16 so that the orientation of connector 16 coincides with the Y-axis direction and the distance between cable-side representative point PM1 and connector-side representative point PM 2 is an appropriate distance (positioning step in step ST10). The positioning of cable 14 with respect to connector 16 is performed by moving head unit 28 by robot unit 27.

Figure 21A:
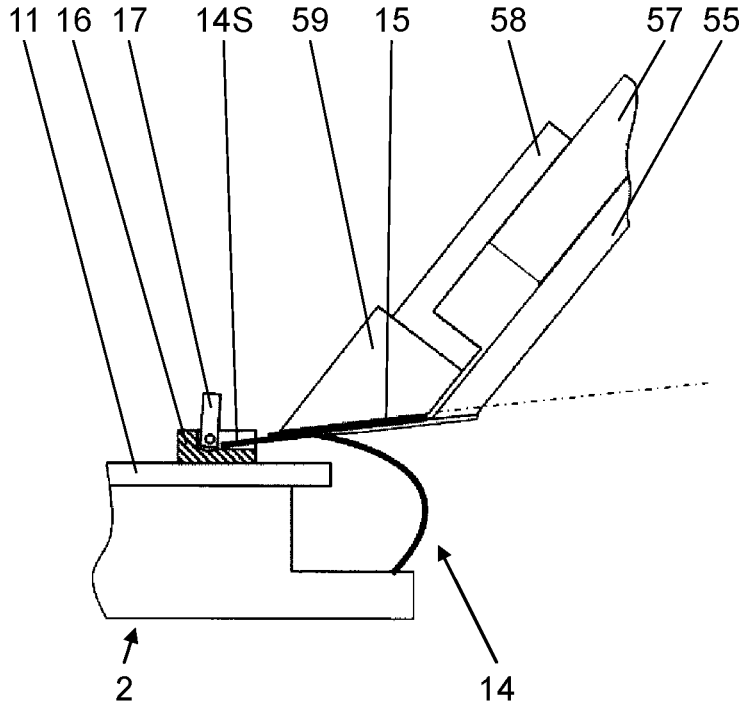
FIG. 21A is a view illustrating a state where a cable holder included in the electronic device assembling apparatus according to the exemplary embodiment inserts a cable into a connector.
Figure 21B:
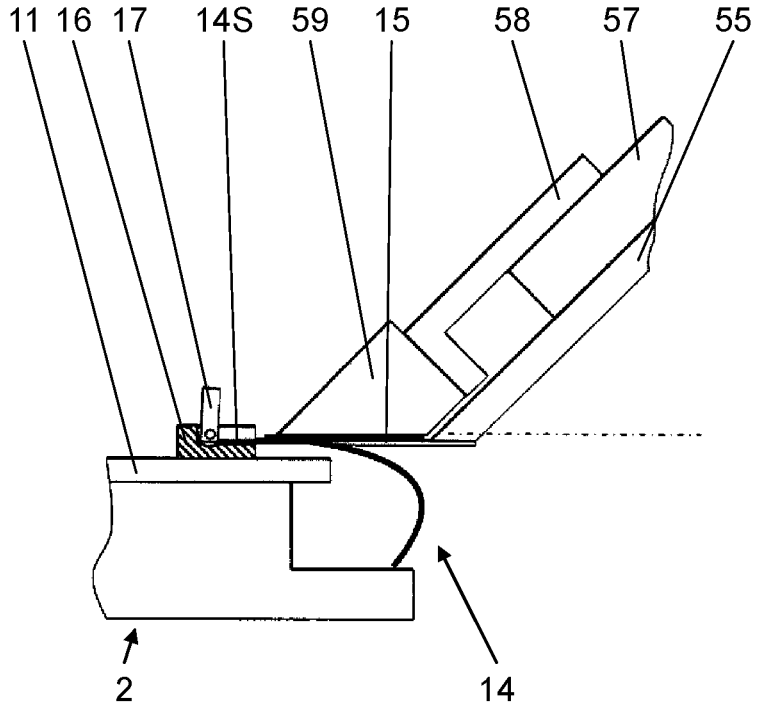
FIG. 21B is a view illustrating a state where a cable holder included in the electronic device assembling apparatus according to the exemplary embodiment inserts a cable into a connector.

After the positioning of cable 14 with respect to connector 16, robot unit 27 moves head unit 28 to insert tip portion 14S of cable 14 held by cable holder 41 into cable receiving unit 16*a* of connector 16 (FIG. 21A. Cable insertion step of step ST11). At this time, robot unit 27 inserts tip portion 14S of cable 14 obliquely from above with respect to connector 16, and then moves cable holder 41 so that reinforcing plate 15 becomes substantially a horizontal posture (FIG. 21B). When tip portion 14S of cable 14 is inserted into connector 16 as described above, even in a case where the tip of blade 56 abuts against electronic device 2 or the like, spring member 54 which is provided between moving block 53 and downward extending portion 33*a* is compressed and releases the impact. Therefore, excessive force is prevented from acting on blade 56.

Figure 22A:
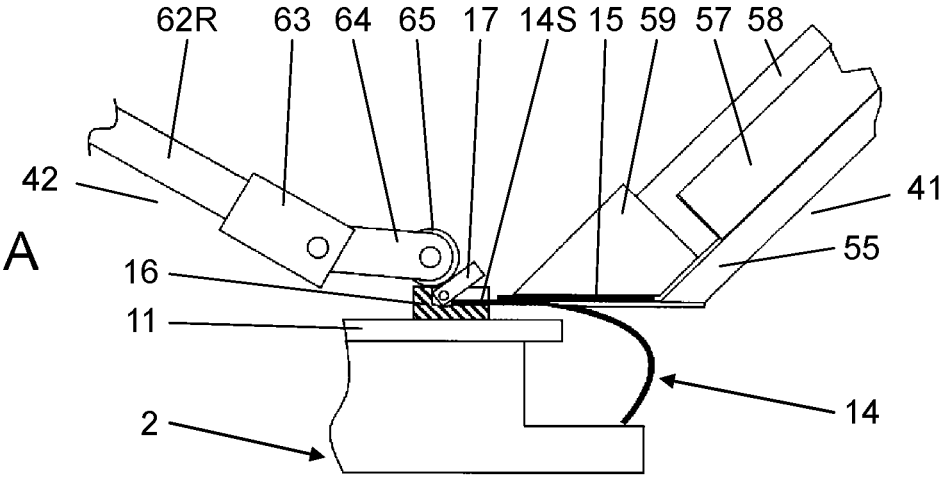
FIG. 22A is a view illustrating a state where a lock member is being operated by a lock member operator included in the electronic device assembling apparatus according to the exemplary embodiment.
Figure 22B:
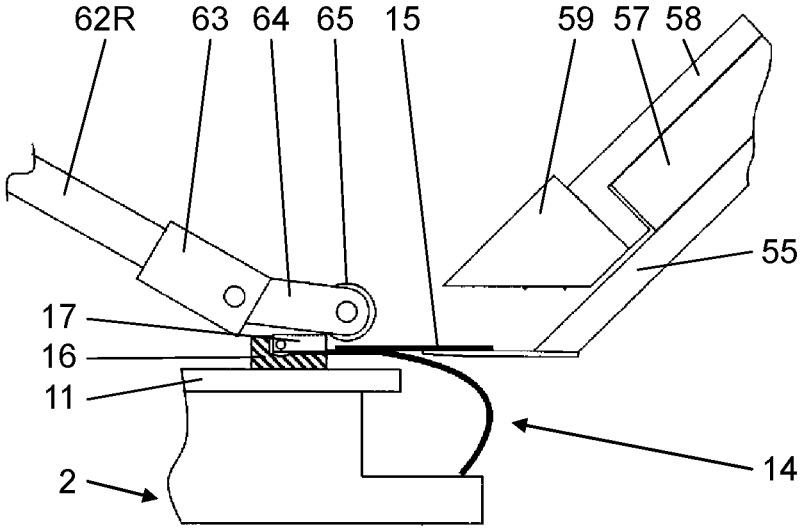
FIG. 22B is a view illustrating a state where a lock member is being operated by a lock member operator included in the electronic device assembling apparatus according to the exemplary embodiment.

When the posture of cable 14 is adjusted, lock member 17 is operated by lock member operator 42 to lock cable 14 inserted in connector 16 to connector 16 (lock member operating step in step ST12). Specifically, robot unit 27 moves head unit 28, positions roller 65 of lock member operator 42 on the rear side of lock member 17 and then advances piston rod 62R downward. Accordingly, roller 65 abuts against lock member 17 from the rear side and presses while rolling on lock member 17 (FIG. 22A→FIG. 22B). Accordingly, lock member 17 lies down to the closing posture, cable-side terminal 14T is pressed against connector-side terminal 16 T, and cable 14 is locked to connector 16.

In the locking member operating step, when roller 65 abuts against the rear surface side of locking member 17 and the pressing (lying down) of locking member 17 is started, cable holder 41 maintains a state of holding cable 14 (FIG. 22A). Here, a state where cable 14 is held means a state where cable 14 is interposed by blade 56 and chuck block 59. Then, only after the pressing of lock member 17 by roller 65 is started, chuck block 59 is lifted with respect to blade 56, and the pinching (chucking state) of reinforcing plate 15 is released. In other words, lock member operator 42 starts an operation of lock member 17 in a state where cable 14 inserted into connector 16 is held by cable holder 41.

As described above, in the exemplary embodiment, the operation of lock member operator 42 in the lock member operating step is started in a state where cable 14 inserted into connector 16 is held by cable holder 41. Therefore, even in a case where some disturbance acts on cable 14 before cable 14 inserted into connector 16 by cable holder 41 is locked to connector 16 by locking member 17, it is possible to prevent cable 14 from falling off from connector 16.

In addition, buffer portion 63 is provided between roller 65 and lock cylinder 62. In the lock member operating step, when roller 65 abuts against lock member 17 in the lock member operating step, roller 65 receives an impact from lock member 17, but the impact applied to roller 65 by buffer portion 63 is alleviated. Therefore, the impact received by roller 65 is unlikely to be transmitted to lock cylinder 62, and lock cylinder 62 is protected from impact.

Figure 22C:
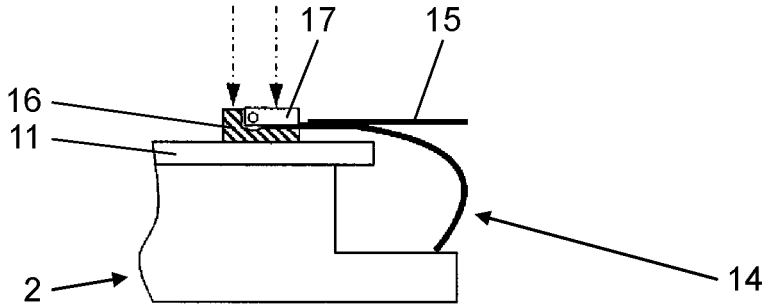
FIG. 22C is a view illustrating a state where a lock member is being operated by a lock member operator included in the electronic device assembling apparatus according to the exemplary embodiment.

After the locking member operating step is completed, it is inspected whether or not locking member 17 locked by the locking member operator 42 is in the closing posture (closing posture inspecting step of step ST13). Specifically, robot unit 27 moves head unit 28 to position locking unit opening/closing sensor 45 above connector 16 (FIG. 10). Then, lock unit opening/closing sensor 45 irradiates measurement light from locking unit opening/closing sensor 45 toward connector 16, and receives the reflected light thereof. Accordingly, locking unit opening/closing sensor 45 detects the opening/closing state of locking member 17 provided on connector 16 (FIG. 22 (*c*)).

As a result of inspecting whether or not lock member 17 is in the closing posture, in a case where lock member 17 was not in the closing posture, controller 90 temporarily stops the work and then, through touch panel 29, the fact that lock member 17 is not closed (opened) is notified (notification step in step ST14). The worker who received this notification manually closes lock member 17 and performs an operation to resume the work from touch panel 29.

In a case where it is detected that locking member 17 is in the closing posture in the closing posture inspecting step, or in a case where the operation for resuming work is performed from touch panel 29 after it is detected that lock member 17 is in the opening posture in the closing posture inspecting step, assuming that cable 14 is normally connected to connector 16, the cable installation work per one of connectors 16 is completed. In a case where the other cable 14 is installed to corresponding connector 16, work stage 22 is rotated, work stage 22 (that is, electronic device 2) is relatively moved with respect to cable holder 41, the same step is installed.

As described above, in electronic device assembling apparatus 1 and the assembling method (electronic device assembling method) of electronic device 2 by electronic device assembling apparatus 1 according to the exemplary embodiment, cable holder 41 holds cable 14 and inserts cable 14 into connector 16. Therefore, it is possible to perform the operation of inserting the cable into the connector with a simple structure without using two robots in an operation for inserting the cable into the connector as in the related art. As a result, the work quality of the assembling work of the electronic device is improved.

In addition, in electronic device assembling apparatus 1 and the electronic device assembling method according to the exemplary embodiment, the operation of lock member 17 for locking cable 14 inserted into connector 16 to connector 16 is started in a state which cable 14 is held by cable holder 41. Therefore, even in a case where some disturbance acts on cable 14 after cable 14 is inserted into connector 16 by cable holder 41 and before lock member 17 lies down and cable 14 is locked to connector 16, cable 14 is prevented from falling off connector 16. As a result, the occurrence of an assembly mistake of electronic device 2 can be prevented.

Although exemplary embodiments of this disclosure have been described so far, the present invention is not limited to the above-described exemplary embodiments. For example, in the above-described exemplary embodiment, cable holder 41 included in electronic device assembling apparatus 1 is configured to hold cable 14 by interposing reinforcing plate 15 provided on cable 14. However, both side edges of cable 14 may be interposed from the side of cable 14. In this case, reinforcing plate 15 may or may not be attached to cable 14.

According to this disclosure, it is possible to perform the operation of inserting the cable into the connector with a simple configuration, and it is possible to improve the operation quality of the assembling work of the electronic device.

What is claimed is:

1. An electronic device assembling apparatus that assembles an electronic device by inserting a cable into a connector and locking the cable with a lock member of the connector, the apparatus comprising:

a cable holder which holds the cable and inserts the cable into the connector;

a lock member operator which operates the lock member to lock the cable to the connector, after the cable is inserted into the connector by the cable holder;

a robot unit which includes a moving base, the cable holder and the lock member operator being installed on the moving base, wherein the robot unit is configured to move the cable holder and the lock member operator relative to the electronic device by moving the moving base; and a controller which is configured to install the cable onto the connector by moving the robot unit, the cable holder, and the lock member operator, wherein the lock member operator starts an operation with respect to the lock member in a state where the cable inserted into the connector is held by the cable holder.

2. The electronic device assembling apparatus of claim 1, wherein the lock member receives the insertion of the cable by the cable holder in an opening posture, and locks the cable to the connector when the lock member is in a closing posture in a state where the cable is inserted into the connector.

3. The electronic device assembling apparatus of claim 2, wherein the opening posture is a state where the lock member stands up against a terminal of the connector, and the closing posture is a state where the lock member lies down toward the terminal of the connector.

4. The electronic device assembling apparatus of claim 1, wherein the lock member operator has a roller, and wherein the operation with respect to the lock member is a pressing of the lock member by the roller.

5. The electronic device assembling apparatus of claim 4, wherein the cable holder releases holding of the cable, after pressing of the lock member by the roller is started.

6. An electronic device assembling method for assembling the electronic device using the electronic device assembling apparatus of claim 1, the method comprising:

a step of holding the cable in the cable holder;

a step of operating the cable holder to insert the cable into the connector; and a step of operating the lock member by the lock member operator to lock the cable to the connector, wherein the step of operating the lock member is started in the state where the cable inserted into the connector is held by the cable holder.

7. The electronic device assembling apparatus of claim 1, wherein the lock member is pivotable between an opening posture and a closing posture.

8. The electronic device assembling apparatus of claim 7, wherein when the cable is inserted into the connector and the lock member is in the closing posture, the cable is pinched between a cable receiver of the connector and the lock member.

9. The electronic device assembling apparatus of claim 1, wherein:

a reinforcing plate is attached to the cable, the cable holder includes a chuck block and a blade, and the cable holder is configured to hold the cable by holding the reinforcing plate between the chuck block and blade.

10. The electronic device assembling apparatus of claim 1, wherein the cable includes a main body that is ribbon shaped.

* * * * *